US005183240A

United States Patent [19]

Morooka et al.

[11] Patent Number: 5,183,240

[45] Date of Patent: Feb. 2, 1993

[54] AUTOMATIC DOCUMENT FEEDER

[75] Inventors: Toru Morooka, Yamato-Koriyama; Yuji Okamoto, Nara, both of Japan

[73] Assignee: Sharp Kabushiki Kaisha, Osaka, Japan

[21] Appl. No.: 764,199

[22] Filed: Sep. 23, 1991

[30] Foreign Application Priority Data

Sep. 28, 1990 [JP] Japan ..... 2-262644
Feb. 22, 1991 [JP] Japan ..... 3-28693
Sep. 4, 1991 [JP] Japan ..... 3-224109

[51] Int. Cl.[5] ..... B65H 5/22

[52] U.S. Cl. ..... 271/3.1; 271/258; 271/265

[58] Field of Search ..... 355/320; 271/110, 111, 271/258, 259, 265, 3.1

[56] References Cited

U.S. PATENT DOCUMENTS 3,806,239 4/1974 Inoue et al. .
4,076,408 2/1978 Reid et al. .
4,259,711 3/1981 Mochizuki .
4,380,389 4/1983 Kingsley .
4,429,866 2/1984 Castro-Hahn .
4,551,813 11/1985 Sanbayashi et.al. ..... 271/258
4,763,160 8/1988 Honjo ..... 271/259
4,804,998 2/1989 Miyawaki ..... 271/258
4,933,722 6/1990 Fujiwara .
4,970,606 11/1990 Shima .
4,980,729 12/1990 Okamoto ..... 355/320
5,056,771 10/1991 Beck et al. ..... 271/265

FOREIGN PATENT DOCUMENTS 0308047 3/1989 European Pat. Off. .
0315427 5/1989 European Pat. Off. .
0328722 8/1989 European Pat. Off. .
0104856 6/1983 Japan ..... 271/110

OTHER PUBLICATIONS

IBM Technical Disclosure Bulletin, Conly et al, Job Interrupt After Copies Jams, Jun. 1982, vol. 25, No. 1, pp. 249-250.

*Primary Examiner*—H. Grant Skaggs

[57] ABSTRACT

A sensor (SEN6*a*) is provided for detecting a presence of a document sheet at a specified position during a transit path of document sheets supplied. According to detection output from this sensor (SEN6*a*), a continuous presence time of a document sheet is obtained, and if the continuous presence time obtained is longer than the continuous document presence time obtained last time, this is regarded as an indication of a multiple feed of document sheets, and the feeding of document sheets is stopped.

9 Claims, 18 Drawing Sheets

START
t ← 0
S1
SENSOR SEN6a OUTPUT "ON" SIGNAL ?
S2
YES
NO
TIMER ← 1ms
S3
TIMER PERIOD ENDED ?
S4
YES
NO
t ← t + 1
S5
SENSOR SEN6a OUTPUTS "OFF" SIGNAL ?
S6
YES
NO
t' ← t
S8

START
S400
t ← 0
S401
SENSOR SEN6a OUTPUTS 'ON' SIGNAL ?
YES
NO
S402
TIMER ← 1ms
S403
TIMER PERIOD ENDED ?
YES
NO
S404
t ← t + 1
S405
SENSOR SEN6a OUTPUTS "OFF" SIGNAL ?
YES
NO

START
S500
t ← 0
S501
FIRST EXPOSURE STATION ?
YES
NO
S502
SENSOR SEN6b OUTPUTS "ON" SIGNAL ?
YES
NO
S503
SENSOR SEN6a OUTPUTS "ON" SIGNAL ?
YES
NO
S504
TIMER ← 1ms
S505
TIMER PERIOD ENDED ?
YES
NO
S506
t ← t+1
S507
FIRST EXPOSURE STATION ?
YES
NO
S508
SENSOR SEN6b OUTPUTS "OFF" SIGNAL ?
YES
NO
S511
t' ← t

AUTOMATIC DOCUMENT FEEDER

BACKGROUND OF THE INVENTION

1. Field of the Invention

The present invention relates to an automatic document feeder for automatically feeding a plurality of documents, such as document sheets, to be copied.

2. Description of the Related Art

In an automatic document feeder, particularly in a recycle document handler, a mechanism is provided which prevents simultaneous feeding of a plurality of document sheets lying one upon another (hereafter referred to as a multiple feed). Nevertheless, a multiple feed of document sheets (originals) sometimes occurs.

There is a prior art for preventing a multiple feed when copies are made by using a recycle document handler (Japanese Patent Application Laying Open (KOKAI) No. 52-119940). In this prior art, when a set of original sheets has been copied, the number of document sheets presented for copying is stored in memory. This number is compared with the number of document sheets circulated for copying after the next set of document sheets has been copied. When these numbers differ, a multiple feed is indicated, and the document handler is shut down.

According to the prior art mentioned above, it is after a set of document sheets has been circulated that a decision can be made whether a multiple feed has occurred. Until then, copying of the document sheets is continued. A resulting problem is that many document sheets which are involved in a multiple feed are not copied. Above all, when duplex copying is performed, there is another problem that ineffective copying occurs in which front and back combinations of the contents of the document sheets are displaced with respect to each other by a multiple feed.

When the number of document sheets is counted and the sheets are copied according to the counted number, if a multiple feed occurs, this results in a wrong counting of the number of document sheets and the copying operation is controlled according to a wrong number of document sheets. If in this case duplex copying is performed on a number of copying paper from simplex document sheets, many copies are made by ineffective copying in which the front and back combinations of the contents of document sheets are displaced with respect to each other.

SUMMARY OF THE INVENTION

Therefore, an object of the present invention is to provide an automatic document feeder for minimizing an occurrence of unexecuted copying or ineffective copying owing to a multiple feed of document sheets.

According to the present invention, the above object can be achieved by an automatic document feeder for automatically feeding a plurality of document sheets, said document feeder comprising a sensor, provided near a transit path of document sheets supplied, for detecting a presence of a document sheet at a position where the sensor is located, means for obtaining a continuous presence time of a document sheet according to detection output from the sensor, and stopping means for stopping the supply of document sheets since it is considered that a multiple feed has occurred when the continuous presence time obtained this time is longer than the continuous presence time of a document sheet obtained last time.

Specifically, in the present invention, a sensor, which is provided during a transit path of document sheets supplied, that is, near the middle of a transfer path or at an exposure station, for example, detects whether a document sheet actually passes the position where the sensor is located. This detection is done by a contact sensor contacting a document sheet or by a photo sensor detecting a reflected light or a transmitted light from a document sheet. Since the transfer speed of a document sheet is constant, a continuous presence time of a document sheet can be obtained from detection output from the sensor. When document sheets are transferred correctly, the continous document presence times obtained this time and last time ought to be equal. Therefore, when the continuous time obtained this time is compared with the continuous presence time obtained last time, if the continuous presence time obtained this time is longer than the continuous presence time obtained last time, a decision is made that a multiple feed has occurred, and the above-mentioned supply of document sheets is stopped. Therefore, the copying operation can be stopped by detecting a multiple feed accurately and immediately, and as a result, an occurrence of unexecuted copying or ineffective copying due to a multiple feed can be minimized.

It is desirable to provide means for idly transferring the document sheets until the document sheets up to the document sheet just before the occurrence of the multiple feed retransferred, and means for resuming the supply of document sheets after the idle transfer is done by the above-mentioned idle transfer means. By this arrangement, not only copying can be stopped by detecting an occurrence of a multiple feed accurately and immediately, but also recovery is achieved by automatically circulating the document sheets so that copying can be resumed with the consecutive document sheets which were transferred simultaneously by a multiple feed. Therefore, time loss can be minimized, and an occurrence of unexecuted copying or ineffective copying due to a multiple feed can be minimized.

It is also desirable to provide means for separating the document sheets involved in the multiple feed after the idle transfer is done by the idle transfer means, and means for restarting the supply of document sheets after the document sheets are separated by the document separating means. If the document sheets sent simultaneously lying one upon another are separated before restarting the supply of document sheets, needless to say, copying can be stopped by detecting an occurrence of a multiple feed accurately and immediately. In addition, the document sheets involved in the multiple feed are recovered by separating with an increased separating force when the document sheets are circulated automatically so that copying can be restarted with the consecutive document sheets simultaneously transferred. Therefore, a recurrence of a multiple feed, which may occur with the same document sheets, can be prevented securely, so that an occurrence of unexecuted copying or ineffective copying due to a multiple feed can be minimized.

According to the present invention, the above object can be achieved by an automatic document feeder comprising means for counting the number of document sheets supplied, a sensor, provided near a transit path of document sheets supplied, for detecting a presence of a document sheet at the position where the sensor is located, means for obtaining a continuous presence time of a document sheet according to detection output from the sensor, counting stopping means for stopping the above-mentioned counting of document sheets as it is considered that a multiple feed has occurred when the continuous presence time obtained is longer than a specified time determined according to the size of a document sheet, means for idly transferring the document sheets until the document sheets up to the document sheet just before the occurrence of a multiple feed have been circulated when the above-mentioned counting is stopped by an occurrence of a multiple feed, and means for restarting the counting of the document sheets after the idle transfer is done by the idle transfer means.

When the number of document sheets supplied is counted, this counting is stopped when a multiple feed has occurred. And, the counting of the document sheets is restarted after the document sheets are transferred idly until the document sheets up to the document sheet just before the occurrence of the multiple feed have been circulated. This enables a prevention of copying according to a wrong number of document sheets resulting from an erroneous counting due to the multiple feed. In other words, since copying can be performed according to a correct number of document sheets, when copying is done according to the number of document sheets counted as in the mode of producing duplex copies from simplex document sheets, for example, it is possible to minimize an occurrence of unexecuted copying or ineffective copying resulting from a displacement of the contents on the front and back sides of the document sheets with respect to each other.

When an occurrence of a multiple feed is decided, instead of a continuous presence of a document sheet obtained last time, a specified time determined according to the size of a document sheet may be obtained.

It is desirable to provide transfer stopping means for stopping the transfer of document sheets as it is considered that a jamming has occurred when the obtained continuous presence time of a document sheet is considerably longer than the specified time, mentioned above, which is determined according to the size of a document sheet. This enables a prevention of such an accident that the simultaneously-fed document sheets X displaced so greatly with respect to each other that they cannot return in their entirety into the document hopper, a part of the rear one of the simultaneously-fed document sheets is left extending into the transfer path and damaged by the rollers, for example, or in the worst case, the rear one of the simultaneously-fed sheets X does not reach the document hopper and jammed in the transfer process.

Moreover, according to the present invention, the above-mentioned object can be achieved by an automatic document feeder for automatically feeding a plurality of document sheets, which feeder has first and second exposure positions for respectively exposing the front and back sides of a document sheet, the feeder comprising first and second sensors, provided in the vicinity of the first and second exposure positions during the transit path of document sheets supplied, for detecting a presence of a document sheet at the positions where the sensors are provided, means for obtaining continuous presence times of a document sheet according to detection outputs from the first and second sensors, and stopping means for stopping the supply of document sheets when the continuous presence time obtained this time is longer than the continuous presence time of a document sheet obtained last time.

When there are provided first and second exposure positions for exposing the front and back sides of a document sheet, an occurrence of a multiple feed may be decided by obtaining a continuous presence time of a document sheet from detection output from a sensor at one of those exposure positions. Or, an occurrence of a multiple feed may be decided by obtaining a continuous presence time of a document sheet from detection outputs from the sensors at both exposure positions. Thus, sensors are provided at the respective exposure positions for detecting an occurrence of a multiple feed of a document sheet. The sensors are operated by switching over between them. So, copying can be stopped by detecting an occurrence of a multiple feed immediately, so that the occurrence of unexecuted copying or ineffective copying owing to a multiple feed can be reduced to a minimum.

Further objects and advantages of the present invention will be apparent from the following description of the preferred embodiments of the invention as illustrated in the accompanying drawings.

DESCRIPTION OF THE PREFERRED EMBODIMENTS

Figure 1:
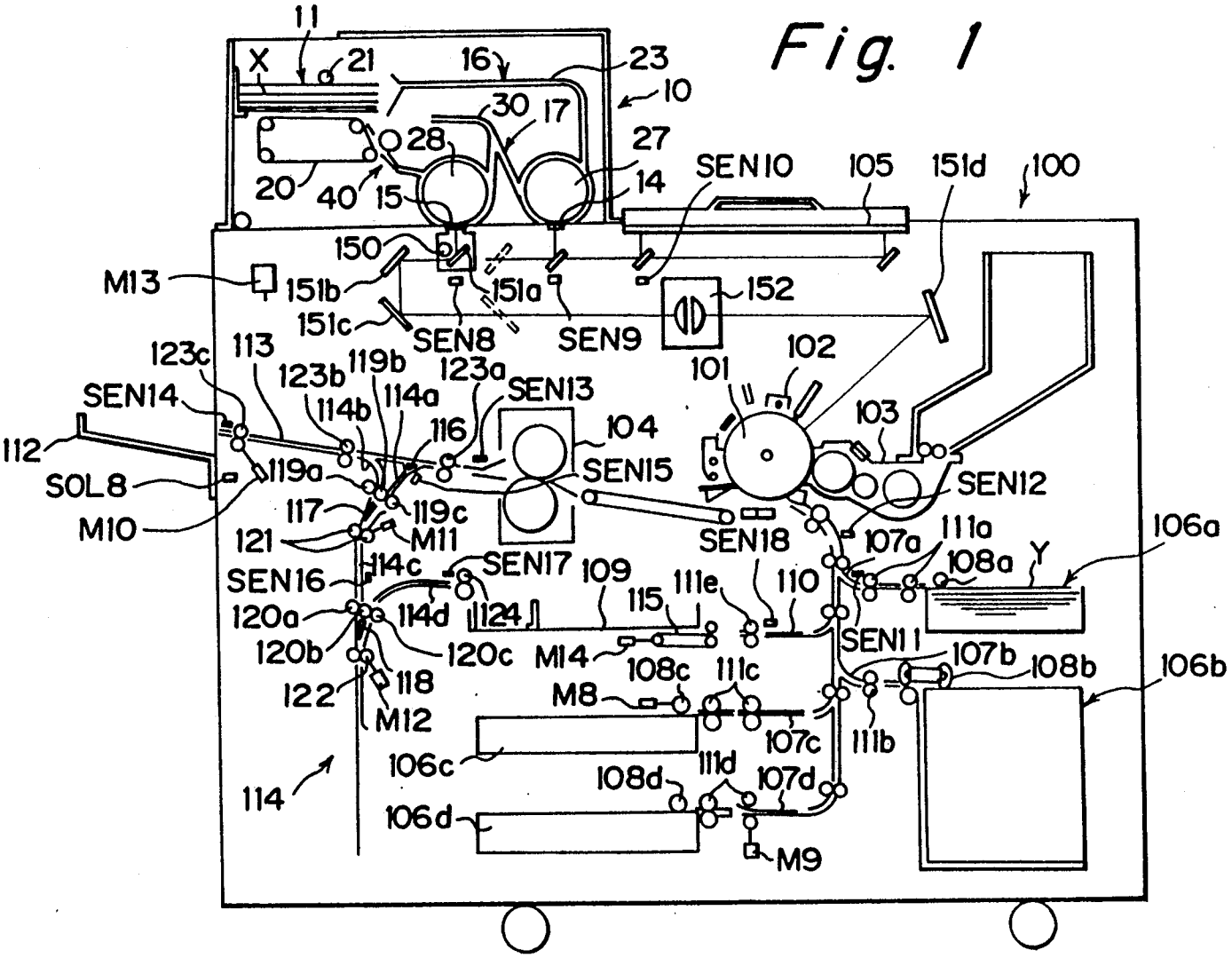
FIG. 1 schematically shows a construction of a duplex copier in a preferred embodiment of the present invention.
Figure 2:
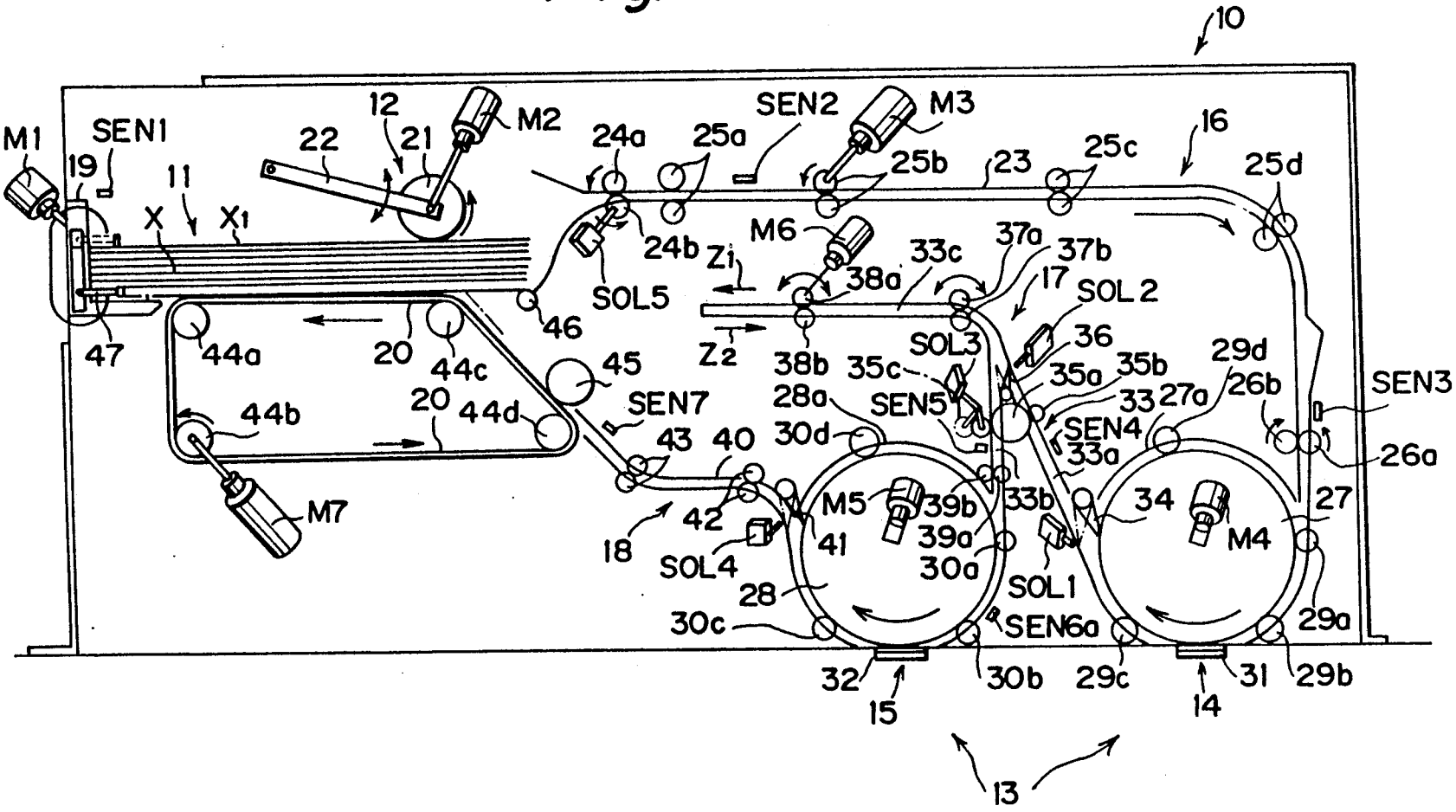
FIG. 2 shows in detail a recycle document handler of the copier in FIG. 1.

FIG. 1 is a construction diagram schematically showing the construction of a duplex copier as a preferred embodiment of the present invention, the duplex copier having a recycle document handler 10 attached thereto. FIG. 2 is a construction diagram showing this recycle document handler 10 in more detail.

In FIG. 2, reference numeral 11 denotes a document sheet hopper, 12 denotes a document sheet feeding mechanism, and 13 denotes a document sheet presenting section comprising a first presenting station 14 and a second presenting station 15. Reference numeral 16 denotes a first transfer mechanism for transferring a document from the document hopper 11 to the first presenting station 14, 17 denotes a second transfer mechanism including a reversing mechanism, disposed between the first presenting station 14 and the second presenting station 15, for reversing the presented side of the document, and 18 denotes a third transfer mechanism for returning the document from the second presenting station 15 to the document hopper 11.

The document hopper 11 is arranged to accept a set of double-sided (duplex) original sheets X of regularly-sequenced pages mounted on a document transfer belt 20 with their edges (the extreme left in FIG. 2) aligned with a side-edge aligning member 19. To separate and feed the original sheets one after another in order from the topmost sheet of the set to the first transfer mechanism 16, there is provided above the document hopper 11 a sheet feed roller 21 constituting a part of the document feeding mechanism 12.

The sheet feed roller 21 is driven to rotate in the arrow direction at timing determined by a document feeding motor M2. When rotated, the sheet feed roller 21 is pressed against the topmost sheet $X_1$ through a lever 22 by a force derived from a solenoid, for example, and sequentially separates and feeds the document sheets in order from the topmost sheet $X_1$ to the first transfer mechanism 16. The sheet feed roller 21 may be arranged to be in constant contact with the topmost sheet by its own weight.

In the first transfer mechanism 16 into which the document sheets are sent from the document hopper 11 by the feed roller 21 one after another, there is a transfer path 23 which extends horizontally and turns vertically downwards as shown in FIG. 2. At the inlet-side end of the transfer path 23, sheet-separating rollers 24*a* and 24*b* are provided which serve to prevent a simultaneous feeding of a plurality of the document sheets X. As indicated by the arrows, the upper roller 24*a* is rotated in the transfer direction, while the lower roller 24*b* is rotated in the opposite direction. The document sheets X are passed through those rollers and sent in succession into the transfer path 23. A solenoid SOL5 is attached to the sheet-separating roller 24*b* to vary the pressing force of the roller. When this solenoid SOL5 is turned on, the pressing force of the roller is increased, thus increasing the separating force for the document sheet.

Along the transfer path 23, there are installed pairs of transfer rollers 25*a*, 25*b*, 25*c*, and 25*d*, mutually spaced in the transfer direction. Those pairs of the rollers 25*a*, 25*b*, 25*c*, and 25*d* are rotatable in engagement with both sides of each document sheet, and forcedly rotated by a document transfer motor M3. For simplicity, FIG. 2 shows as if only the transfer rollers 25*b* are coupled to the document transfer motor M3. By the arrangement described above, the document sheets X are transferred in the arrow direction through the transfer path 23 as they are guided by the rollers.

Sensor SEN2 for detecting feeding of a document sheet is installed in the vicinity of the inlet of the transfer path 23, and sensor SEN3 for detection at the front of the first exposure station is installed in the vicinity of the outlet. A pair of resist rollers 26*a* and 26*b* are provided at the outlet (near the first presenting station) of the transfer path 23. Those resist rollers 26*a* and 26*b* are coupled through a clutch to a drive shaft, not shown, and their motion is set so that the rotation is stopped or resumed by on/off control of the clutch. The on/off control of the clutch is implemented according to the operator's desired mode of copying. For example, when a document sheet X is to be exposed, in order to synchronize the movement of the sheet X with the movement of a copying paper, the transfer of the sheet X is stopped temporarily by stopping the rotation of the resist rollers 26*a* and 26*b*, and after the synchronism with the sheet X is achieved, the resist rollers are rotated further to feed the sheet to the first presenting station 14. On the other hand, when the document sheet X need not be exposed, the resist rollers 26*a* and 26*b* are rotated continuously to let the sheet X pass without stopping its transfer.

The document presenting section 13 comprises the first presenting position 14 (hereafter referred to as the first exposure station) and the second presenting position 15 (hereafter referred to as the second exposure station), respectively provided at positions corresponding to the bottom-end faces of first and second document cylinders 27 and 28 horizontally disposed in parallel and at some distance from each other. The first and second exposure stations 14 and 15 are located on the same plane as illustrated.

The above-mentioned document cylinders 27 and 28 are driven by drive motors M4 and M5 in the arrow directions shown in FIG. 2 at a speed synchronized with the copying speed of a copying paper. A group of driven rollers 29*a*, 29*b*, 29*c*, and 29*d* and a group of driven rollers 30*a*, 30*b*, 30*c*, and 30*d* are provided spaced at fixed distances from each other and respectively along the external circumferential surfaces of the document cylinders 27 and 28. Those driven rollers press the document sheets X against the external circumferential surfaces of the document cylinders 27 and 28, and the sheets look as if they wrap along the circumferential surfaces. More specifically, the document sheets X are transferred along the transfer paths 27*a* and 28*a* along the circumferential surfaces of the document cylinders 27 and 28.

Hard transparent glass plates 31 and 32 are provided perpendicularly downward of the transfer paths 27*a* and 28*a*, thus constituting the first and second exposure stations 14 and 15. A front side image is formed by subjecting the front side of a document sheet X to exposure when a document sheet X passes between the document cylinder 27 and the hard transparent glass 31, and a back side image is formed by subjecting the back side of a document sheet X to exposure when the sheet X passes between the document cylinder 28 and the hard transparent glass 32, which will be described later.

In some cases, at the first and second exposure stations 14 and 15, a document sheet X may not be exposed depending on the operator's desired mode of a copying operation, and the sheet X passes without being exposed.

A document sheet X, which has been transferred through the transfer path of the first transfer mechanism 16, passes the first exposure station 14 of the document presenting section 13 while the document sheet X moves wrapping along the first document cylinder 27 as the sheet X is urged by the rotating force of the resist rollers 26*a* and 26*b*. Installed between the first and second exposure stations 14 and 15 is the second transfer mechanism 17 including a front/back reversing path (switch-back path) for reversing the presented side of the sheet X as shown in FIG. 2.

The front/back reversing path 33 comprises a first path 33*a* and a second path 33*b*, each upwardly sloping from the opposed positions of the transfer paths 27*a* and 28*a* defined by the circumferential surfaces of the first and second document cylinders 27 and 28, and a third path 33*c* extending horizontally from the junction of the paths 33*a* and 33*b*.

A gate flapper 34 is provided at the inlet of the first path 33*a* communicating with the transfer path 27*a* of the first document cylinder 27. By activating this gate flapper 34 with a solenoid SOL1, the document sheet X can be selectively transferred to the first path 33*a* or to the transfer path 27 of the first document cylinder 27 again. To be more specific, the document sheet X that has passed the first exposure station 14 is transferred according to the operator's contents of a copying operation, that is, the sheet X is transferred to the first transfer path 33*a* by switching the gate flapper 34 to the position indicated by the solid line in FIG. 2 when the sheet X needs to be copied once. On the other hand, when the sheet X needs to be exposed more than once, the gate flapper 34 is switched to the position indicated the dashed line in FIG. 2, the sheet X is turned around the first document cylinder 27 through the transfer path 27*a* a specified number of times. After exposures are over, the gate flapper 34 is switched to the solid-lined position, and the sheet X is transferred to the first path 33*a*. Along the first path 33*a*, a sensor SEN4 for detection at the rear of the first exposure station to detect the trailing edge of the sheet X, a pair of rollers 35*a* and 35*b*, and a gate flapper 36 are installed in that order from the upstream side. In response to a detection signal of the sensor SEN4, the following front/back reversing motion (switch-back motion) is controlled.

The document sheet X that has entered the first path 33*a* is driven by the rollers 35*a* and 35*b*, and sent through the gate flapper 36 to the third path 33*c*. Along the third path 33*c*, there are arranged a pair of transfer rollers 37*a* and 37*b* and a pair of transfer rollers 38*a* and 38*b*. The roller 38*a* can be driven either in the forward or reverse direction by a document reversing motor M6. Those rollers drive the sheet X coming out of the gate flapper 36 forwards in the arrow direction $Z_1$ through the third path 33*c*, and when the trailing edge of the sheet X passes the leading end of the gate flapper 36, the sheet X is transferred in the arrow direction $Z_2$ by reversing the rotating direction of the motor M6. At this point, the gate flapper is moved by the solenoid SOL2 to the position of closing the outlet of the first path 33*a* as indicated by the solid line in FIG. 2, thereby securing the transfer of the sheet X to the second path 33*b*.

Along the second path 33*b*, a roller 35*c* is arranged, which is operated by a solenoid SOL3 in cooperation with the roller 35*a* as a pair. In the above-mentioned switch-back motion, the sheet X is turned over by the forward/reverse turning roller. However, this turning-over motion can be done by a belt-transfer or air-transfer equipment, for example.

By being urged by the rotating force of the rollers 35*a* and 35*c*, the document sheet X wraps around the second document cylinder 28, and guided to the second exposure station 15. On the downstream side of the roller 35*c*, there is installed a sensor SEN5 for detection at the front of the second exposure station to detect a passage of the trailing edge of the sheet X.

On the downstream side of the sensor SEN5, a pair of resist rollers 39*a* and 39*b* are installed. The resist rollers 39*a* and 39*b* are coupled through a clutch to a drive shaft, not shown. The resist rollers 39*a* and 39*b* are set so that their rotation is stopped or resumed by on/off control of the clutch. The on/off control of the clutch is performed according to the operator's desired mode of a copying operation. When the document sheet X needs to be exposed, to synchronize with the movement of a copying paper, the sheet is stopped temporarily by stopping the rotation of the rollers 39*a* and 39*b*. After the synchronization with the blank form is achieved, the rollers 39*a* and 39*b* are rotated again to deliver the sheet X to the second exposure station 15. On the other hand, when the sheet X need not be exposed, the rollers 39*a* and 30*b* are rotated continuously to allow the sheet X to pass without stopping. The operation of the solenoid SOL3 is controlled to match the rotating motion of the rollers 39*a* and 39*b*.

As described above, as the transfer direction of the sheet X is reversed at the front/back reversing path 33, the front side of the sheet X comes into contact with the circumferential surface of the second document cylinder 28, and the reverse side becomes the outside and wraps around the second document cylinder 28. As a result, the reverse side of the sheet X is exposed at the second exposure station 15, so that a reverse-side image is formed. In some cases, at the second exposure station 15, the sheet X may be passed without being exposed and moved forward depending on the operator's desired mode of a copying operation.

At the exposure section, to be more precise, between the rollers 30*a* and 30*b* at the transfer path 28*a* of the second document cylinder 28, a sensor SEN6*a* is installed which detects a multiple feed by detecting the presence of document sheets X.

On the downstream side of the second exposure station 15 of the second document cylinder 28, a transfer path 40 of the third transfer mechanism 18 branches out and continues from the transfer path 28*a* of the second document cylinder 28. A gate flapper 41 is provided at this junction.

This gate flapper 41 is operated by a solenoid SOL4, and selectively opens and closes the transfer paths 40 and 28*a*. Specifically, according to the operator's desired mode of a copying operation, that is, when the document sheet X is to be exposed once, the transfer path 28*a* is closed and the sheet X is sent to the transfer path 40. On the other hand, when the sheet X is to be exposed more than once, the transfer path 40 is closed and the sheet X is sent to the transfer path 28*a*, and after rotated a required number of times, the sheet X is sent to the transfer path 40.

The front side of a document sheet X is exposed at the first exposure station 14 of the document presenting section 13, and the reverse side is exposed at the second exposure station 15. Therefore, both front and reverse sides of an original sheet X can be copied. In addition, since a necessary number of times of exposure can be done at the first and second exposure stations, a plurality of copies requested can be produced from the same original sheet X.

The transfer path 40 of the third transfer mechanism 18 for returning the document sheets from the second exposure station 15 to the document hopper 11 is connected to the lowermost portion of the transfer belt 20, and the sheet X is delivered to the transfer belt 20. To be more concrete, along the transfer path 40, there are installed transfer rollers 42 and 43 in pairs, and those rollers serve to advance the document sheets X. Near the outlet of the transfer path 40, there is installed a sensor SEN7 for detection prior to the return to the document hopper to detect a passage of a sheet X. In response to a detection signal from the sensor SEN7, the transfer belt 20 and the operation controller of the document hopper 11 are controlled.

The transfer belt 20 is applied on drive rollers 44*a*, 44*b*, 44*c* and 44*d* installed at upper, lower, left and right positions as shown in FIG. 2. The transfer belt 20 is driven and circulated in the arrow direction as the drive roller 44*b* is rotated in the arrow direction by a return transfer motor M7. This motor M7 is driven in response to a detection signal from the sensor SEN7 mentioned above.

The topmost surface of the transfer belt 20 constitutes the hopper of document sheets X, and a document drawing-in roller 45 at a position close to the transfer path 40. The document sheets X are sent as if they creep under the lowermost one of the sheets stacked on the upper surface of the transfer belt 20 by the transfer force of the roller 45 and the transfer belt 20. At this point, to ensure a smooth transfer, a roller 46 is installed for springing up the trailing edges of the sheets X under the trailing edges of the sheets X. By the work of this roller 46, the trailing edges of the stack of the sheets X are raised to securely widen the opening for sheet insertion under the lowermost sheet X. When the leading edge of the sheet X sent to the lowermost position reaches the edge aligning member 19 for aligning the edges of the sheets, the drive motor M7 of the transfer belt 20 is stopped to arrest the movement of the sheet X.

In the document hopper 11, there is provided an actuator 47 for detecting once circulation of a set of document sheets mounted on the hopper 11 as shown in FIG. 2. This actuator 47 is located at the lowermost position indicated by the solid line in FIG. 2 before the operator mounts the document sheets X on the hopper 11, and on this actuator 47, the sheets X are mounted. As the sheets X are fed and return one after another to this position, the actuator rises incrementally. When a set of the sheets X have completed one circulation, the actuator 47 reaches the highest position as indicated by the broken line. The actuator 47 that has reached this highest position is detected by a sensor SEN1 for detecting completion of one circulation of the set of the sheets X in the supply hopper, a detection signal representing the completion of one document circulation is issued. By using this detection signal, the operational items of the copier main body, such as the number of copies that the operator desires, are controlled. After this, the actuator 47 is rotated 180 degrees by a drive motor M1 for driving the actuator for detecting one circulation of document sheets X, and returns to the lowermost position (original position) of the sheets X.

Referring now to FIG. 1, description will be made of a duplex copier including a recycle document handler.

A photosensitive body drum 101 is installed rotatably in the internal center of the copier main body 100 as shown in FIG. 1. Around the circumference of this photosensitive body drum 101, there are provided various copying process elements as image forming means and a fixing unit 104 at the left side of this figure as well as an electrostatic charger 102 and a developing unit 103.

A recycle document handler 10, shown in FIG. 2, is provided at one side on the top of the copier main body 100. A first exposure station 14 and a second exposure station 15, located perpendicularly downward of a first document cylinder 27 and a second document cylinder 28 of this document handler 10, are provided in parallel in approximately the same plane at the top surface of the copier main body 10. At the other side of the top surface of the copier main body 100, a third exposure station 105 for copying book-style documents is provided, so that an optical system having two separate exposure systems is formed in this copier.

Paper cassettes 106*a*, 106*b*, 106*c*, and 106*d* for supplying copying paper Y are loaded in the copier main body 100. The copying paper Y, mounted in those supply cassettes 106*a*, 106*b*, 106*c*, and 106*d*, is removed one after another in order from the top of the paper stack. Paper feed rollers 108*a*, 108*b*, 108*c*, and 108*d* are driven and rotated by paper drive motors M8, so that the paper is delivered one piece after another into paper supply paths 107*a*, 107*b*, 107*c*, and 107*d*. Paper transfer rollers 111*a*, 111*b*, 111*c*, 111*d*, and 111*e* are installed at the supply paths 107*a*, 107*b*, 107*c*, 107*d* and a retransfer path 110 from an intermediate tray 109, which will be described later. Those transfer rollers 111*a*, 111*b*, 111*c*, 111*d*, and 111*e* are driven and rotated by a drive motor M9 to supply the copying process with the copying paper Y. For simplicity of the construction illustration, FIG. 1 shows as if only the transfer roller 111*d* is connected to the drive motor M9.

An offset tray 112 is installed on the external side face of the copier main body 100, and a solenoid SOL8 is provided for use with the offset tray 112. When the solenoid SOL8 has been on for a predetermined time, the offset tray 112 shifts in a direction as if rising above from FIG. 1. Then, when the SOL8 has been on for a predetermined time, the offset tray 112 shifts in a direction as if towards the rear side of FIG. 1. By this arrangement, a plurality of copying paper Y are ejected in a sorted state onto the offset tray 112.

In addition, there are provided an election path 113 for ejecting onto the offset tray 112 the copying paper Y which has been fed into the copying process section and passed through the fixing unit 14, and a copying paper front/back reversing path (switch-back path) branching out of the election path 113. The copying paper Y, which has passed the copying process section and the fixing unit 104 and on one side of which paper the original has been copied, is ejected onto the offset tray 112 in one of the following methods according to the operator's desired mode of the copying operation:

(A) The paper Y is permitted to continue its movement through the ejection path 113 and ejected to the offset tray 112.

(B) After sent toward the ejection path 113, to perform copying on the other side of the paper Y, the paper Y is turned over by the switch-back path 114 and is temporarily stored in the intermediate tray 109 to be transferred again to the copying process section. The pieces of copying paper Y stacked on the intermediate tray 109 are removed in order from the bottom of the set of the paper Y and sent by a supply roller 115 driven to rotate by a motor M14 to the retransfer path 110. They are fed again to the copying process section, passed through the fixing unit 104, and sent through the ejection path 113 to the offset tray 112.

(C) After sent toward the ejection path 113, the paper Y is turned over by the switch-back path 114. In order to enable the above three methods, the ejection paths 113 and the switch-back path 114 are structured as shown in FIG. 1. The switch-back path 114 comprises paths 114*a* and 114*b* branching out at two positions of the ejection path 113, a path 114*c* to which the paths 114*a* and 114*b* are joined, and a path 114*d* branching out of the path 114*c* and leading to the intermediate tray 109. A gate flapper 116 is provided at the junction of the path 114*a* and the ejection path 113, a gate flapper 117 at the junction of the paths 114*a* and 114*b*, and a gate flapper 118 at the junction of the paths 114*c* and 114*d*. Those gate flappers are actuated by drive solenoids, not shown, and the copying paper transfer paths are selected automatically according to the operator's desired mode of the copying operation. Rollers 119*a*, 119*b* and 119*c* are provided in the vicinity of the junction of the paths 114*a* and 114*b*, and rollers 120*a*, 120*b* and 120*c* are provided in the vicinity of the junction of the paths 114*a* and 114*b*. Those rollers serve to transfer the copying paper Y. A reversing roller 121 is provided at the path 114*c* in the vicinity of the junction of the paths 114*a* and 114*b*, and is rotated by a drive motor M11 in the forward or reverse direction. By this, the transfer direction of the copying paper Y is reversed. In addition, a reversing roller 122 is provided downstream of the junction of the paths 114*a* and 114*d*, and is rotated by a drive motor M12 in the forward or reverse direction. A sensor SEN14 for detecting an outgoing paper is provided near the outlet of the ejection path 113. Sensors SEN15 and SEN16 for detecting paper overturning are provided near the inlet of the path 114*a* and at the path 114*c*. A sensor SEN17 for detection at the intermediate tray inlet is provided near the outlet of the path 114*d*.

In FIG. 1, reference numerals 123*a*, 123*b* and 123*c* denote transfer rollers arranged along the ejection path 113, and numeral 124 denotes a transfer roller arranged at the path 114*d*. Although FIG. 1 shows as if only the transfer roller 123*c* is connected to a motor M10, but the transfer rollers 123*a*, 123*b* and 123*c* are driven by a motor M10 in synchronism with the copying process section including the photosensitive body drum 101 and the fixing unit 104.

By the above arrangement, in the case of (A) mentioned above, the path 114*a* is closed by the gate flapper 116 to let the copying paper Y to be ejected through the ejection path 113.

In the case of (B), the ejection path 113 is closed by the gate flapper 116, the copying paper Y is guided to the path 114*a* of the switch-back path 114, the path 114*c* is opened with the gate flapper 117, and after passing through the path 114*c*, the transfer direction of the paper is reversed. Furthermore, the path 114*d* is opened with the gate flapper 118, and the copying paper Y is guided into the intermediate tray 109.

In the case of (C), after guided into the path 114*c*, the transfer direction of the copying paper Y is reversed by the reversing roller 121, the path 114*d* is opened with the gate flapper 117, and the copying paper Y is guided through the path 114*b* to the ejection path 113.

The optical system of the copier main body will next be described.

In the internal upper area of the copier main body 100, there is an optical system comprising a light source for slit exposure to the surface of the original, mirrors 151*a*, 151*b*, 151*c*, and 151*d*, and a lens 152, the optical system being installed so as to be able to scan the original freely. In the optical system, a light from the light source 150 is projected onto an image plane of the document sheet X, and the reflected light are transmitted through mirrors 151*a*, 151*b*, 151*c*, 151*d* and a lens 152, and is incident on the surface of the photosensitive body drum 101. This optical system adopts two separate systems. To be more specific, for document sheets X handled with the recycle document handler 10, the first exposure station 14 of the first document cylinder 14 and the second exposure station 15 of the second document cylinder 28 are used to expose document sheets X, and for a book-type original, the original is mounted on the third exposure station 105, and the optical system makes exposure by scanning the original. The mirror system is driven by a drive motor M13.

If a belt type photosensitive body is used and its top surface is arranged to be parallel with the planes formed by the first, second and third exposure stations mentioned above and the lens is formed by a self-focusing photoconductor array, an image can be formed on the photosensitive body without using the mirrors.

In this copier, sensors for detecting the copying paper Y are provided at various positions: SEN8 is a sensor for detecting the second exposure position of the optical system; SEN10 is a sensor for detecting the leading edge of the document at the OC unit; SEN11 is a sensor for detection at the outlet of the copying paper hopper; SEN12 is a sensor for detection prior to the transfer of an image to the copying paper Y; SEN13 is a sensor for detection after the fixing step; SEN17 is a sensor for detecting the presence or absence of the copying paper Y in the intermediate tray; and SEN18 is a sensor for detection at the outlet of the intermediate tray. The devices which are not shown in FIGS. 1 and 2 are a clutch CLT1 for feeding a document sheet X to the first exposure station 14 and a clutch CLT2 for feeding the document sheet X to the second exposure station 15 in the recycle document handler 10, and a clutch CLT3 for synchronization between the copying paper Y and exposure to the leading edge of the document sheet X.

By the duplex copier comprising a recycle document handler, according to the operator's desired mode of the copying operation, it is possible to produce a copy or copies of a document sheet X freely by circulating the document sheet X a plurality of times to obtain:

(a) a plurality of sorted simplex copies made from a simplex document (b) a plurality of sorted duplex copies made from simplex document (c) a plurality of sorted simplex copies made from a duplex document (d) a plurality of sorted duplex copies made from a duplex document Also, according to the operator's desired mode of the copying operation, it is possible to produce a plurality of copies within one circulation of a document sheet X.

Figure 3:
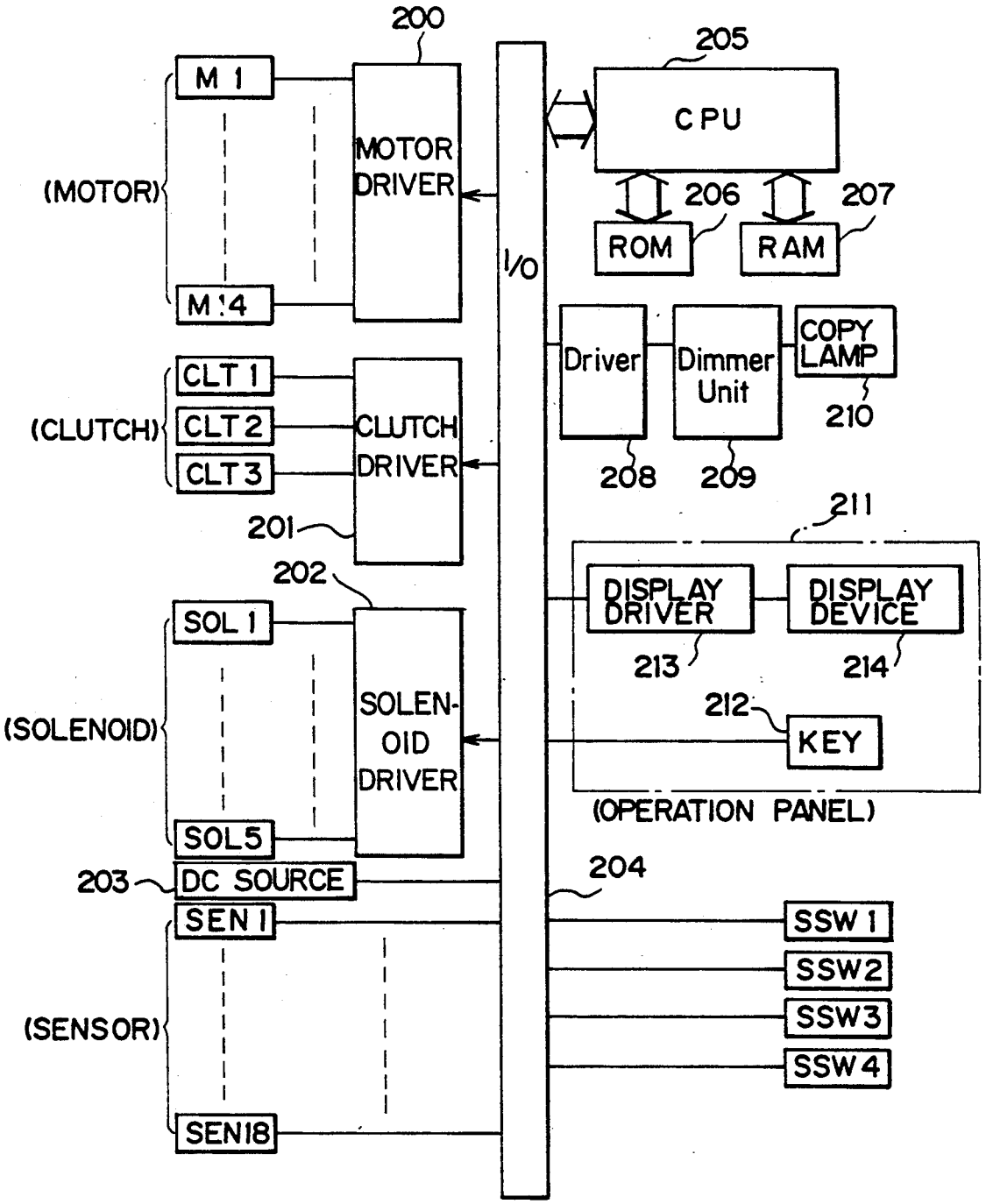
FIG. 3 schematically shows an electric system of a control unit in the embodiment of the present invention in FIG. 1.

FIG. 3 is a block diagram of the control unit of the copier shown in FIG. 1.

By the control unit shown in FIG. 3, the copier main body side and the recycle document handler 10 are controlled in a mutually related manner. Specifically, the motors M1 to M14 are connected to a motor driver 200, the clutches CLT1 to CLT3 to a clutch driver 201, and the solenoids SOL1 to SOL5 to a solenoid driver 202. The drivers 200, 201 and 202, a DC power source 203, and control elements for document transfer control, copying paper transfer control, and process control are connected to an interface circuit (I/O) 204. In addition, the sensors SEN1 to SEN18 are connected to this interface circuit 204. The interface 204, being also connected to a microprocessor 205, outputs detection signals from the sensors SEN1 to SEN18 to the microprocessor 205, and serves to control the above-mentioned drivers 200, 201 and 202 according to control signals from the microprocessor 205. Also connected to ROM (Read Only Memory) 206 and RAM (Random Access Memory) 207, the microprocessor 205 uses control programs stored in ROM 206 for control. RAM 207 is used as a buffer memory and as an operation area for flags, counters, and a timer, described later, which are required for copying control.

The interface circuit 204 is connected through a driver 208 to a dimmer unit 209 and a copy lamp 210, and also connected to an operator key 212 and a display driver 213 on an operation panel 211. This display driver 213 is connected to a display unit 214. In addition, the interface circuit 204 is connected to select switches SSW1 to SSW4.

Figure 4:
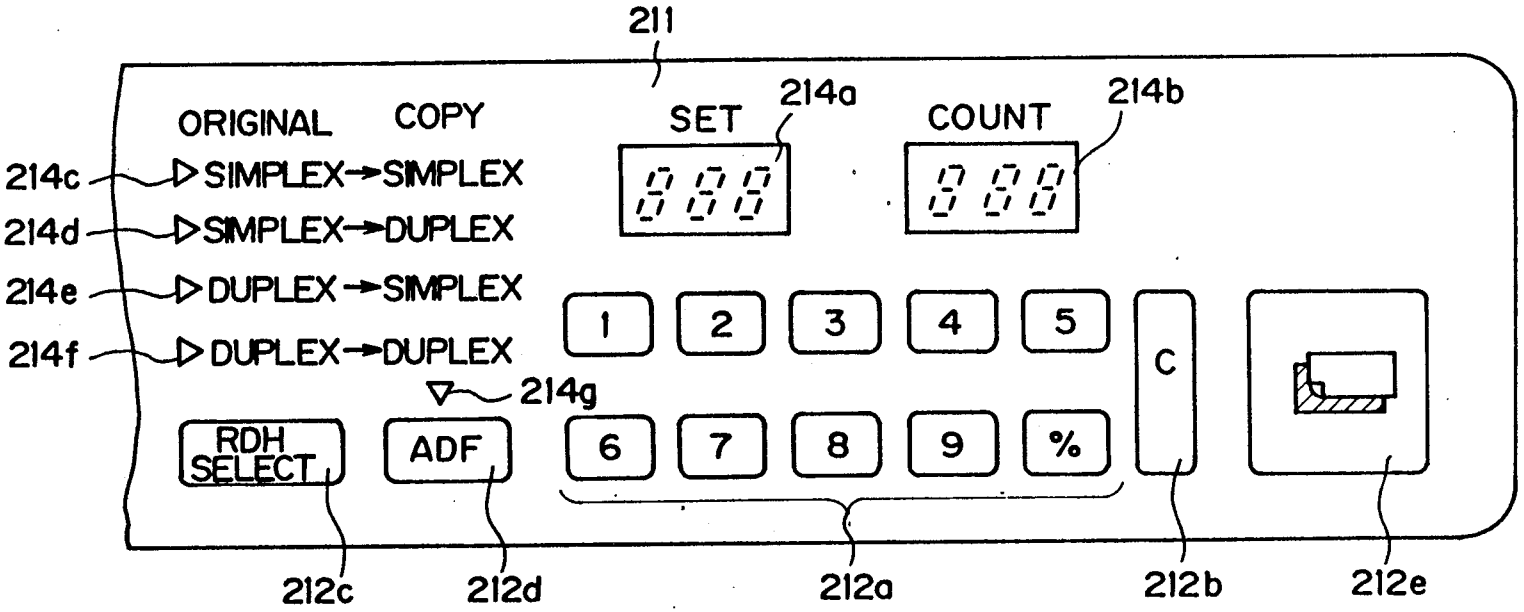
FIG. 4 schematically shows an arrangement of various functions on the operation panel in the embodiment of the present invention in FIG. 1.

FIG. 4 shows functions arranged on the operation panel 211. As shown in FIG. 4, the operation panel 211 comprises a ten-key pad **212*a*, a clear key 212*b*, an RDH-SELECT key 212*c* for setting copying conditions, an ADF key 212*d* for automatic document feed, a print switch 212*e* for indicating the start of copying, a SET display 214*a*, a COUNT display 214*b*, four-kind RDH copying mode indicators 214*c* to 214*f*, and an ADF mode indicator 214*g***.

The RDH copying mode indicators **214*c* to 214*f* respectively indicate the four copying modes: simplex document to simplex copy (SIMPLEX→SIMPLEX), simplex document to duplex copy (SIMPLEX→DUPLEX), duplex document to simplex copy (DUPLEX→SIMPLEX), and duplex document to duplex copy (DUPLEX→DUPLEX). The lit lamp shifts from top down each time the RDH-SELECT key 212*c* is depressed. The lit lamp returns to the bottom position to the top position, and when the copier is initialized, the lit lamp automatically returns to the top position. A necessary number of copies is set with a ten-key pad 212*a*, and the set number is displayed on the SET display 214*a*. When a copying operation is started, the number of copies displayed on the COUNT display 214*b* increases incrementally. When the number of the COUNT display equals the number of the SET display, the machine is shut down, the SET counter is reset, and the SET display returns to "0". The contents of the COUNT counter, hence the contents of the COUNT display 214*b* are maintained until the print switch 212*e*** is turned on.

In the recycle document handler 10, the optical sensor SEN6*a*, for example, which is provided near the exposure section, detects a presence of a document sheet X at the position of the sensor SEN6*a*. More specifically, when the sensor SEN6*a* outputs an ON signal when there is a document sheet X, or outputs an OFF signal when there is not. This detection signal from the sensor SEN6*a* is sent to the microprocessor 205 through the interface circuit 204 shown in FIG. 3. The microprocessor 205 determines if a multiple feed of the sheets X has occurred, and decides whether the operation of the copier is to be shut down.

Figures 5, 5A, 5B:
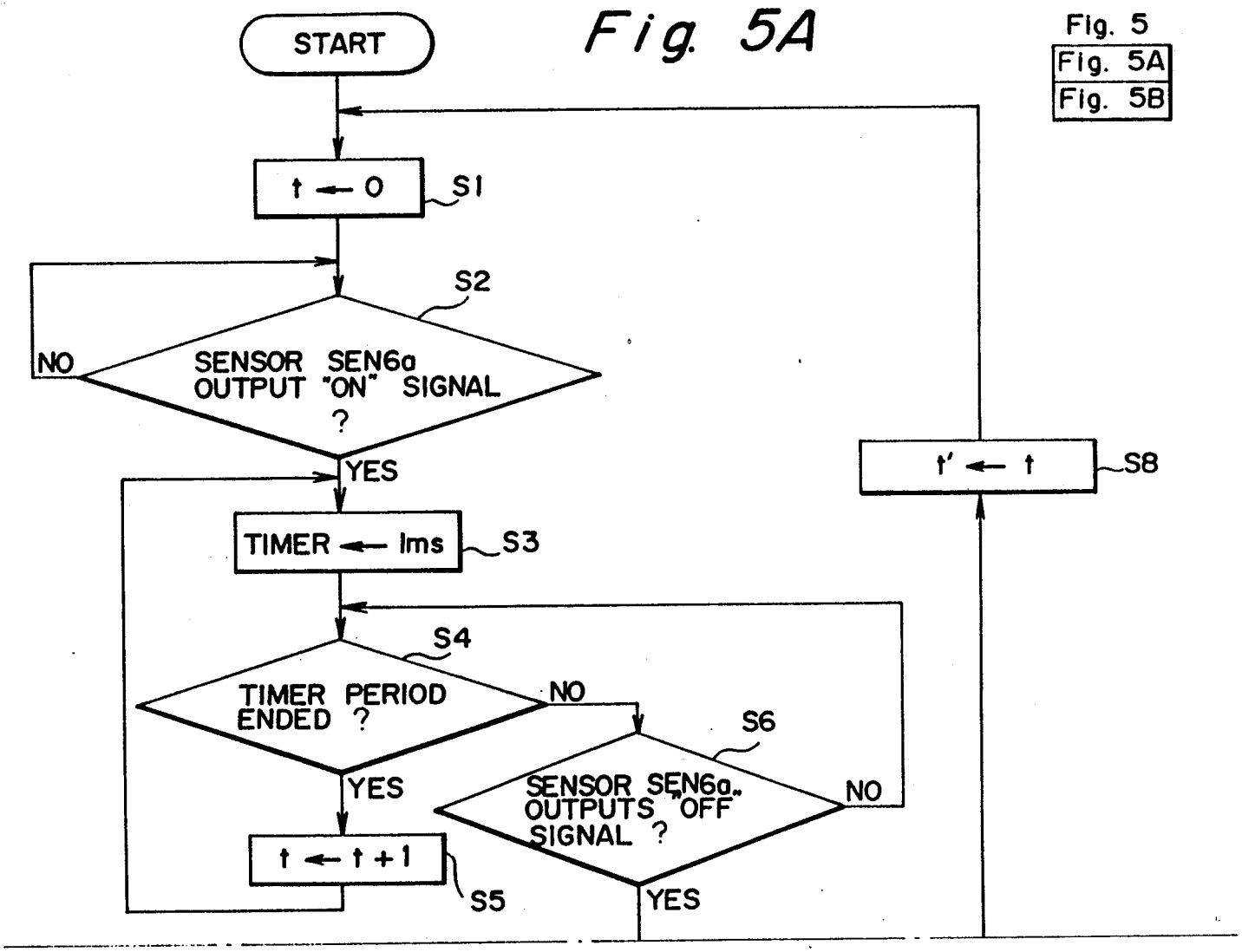
FIG. 5 composed of FIGS. 5A and 5B is a flowchart of a program for determining an occurrence of a multiple feed and also for the operation control of the copier according to this determination in the embodiment in FIG. 1.
Figure 5B:
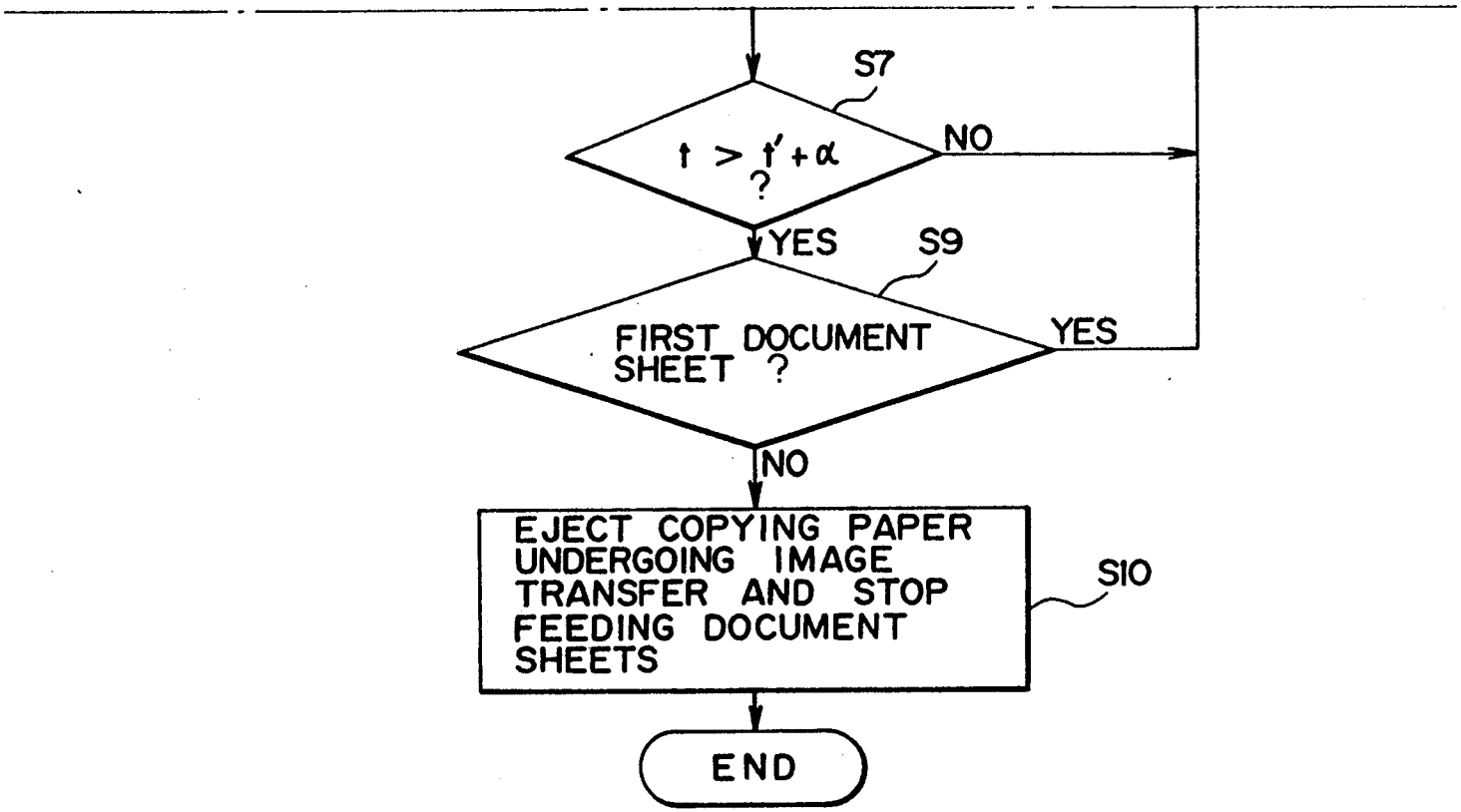

FIG. 5 composed of FIGS. 5A and 5B is a flowchart of a program that the microprocessor 205 executes to determine if a multiple feed has occurred and to control the operation of the copier according to this determination.

When the operation of the document handler 10 is started, at step S1 the contents of the forward counter are initialized by $t \leftarrow 0$. At the next step S2, a decision is made repeatedly whether or not an ON signal has been given from the sensor SEN6*a*, that is to say, whether the sensor SEN6*a* has detected the presence of a document sheet X at the position of the sensor SEN6*a*.

Only when an ON signal has been given from the sensor SEN6*a*, the program proceeds to step S3, where a value corresponding to 1 ms is set on the timer. At the subsequent step S4, a decision is made whether the timer has finished counting, i.e., whether 1 ms has elapsed. When 1 ms has elapsed, the program moves on to step S5, where the contents t of the forward counter are incremented, and the program returns to step S3. In other words, $t \leftarrow t+1$ is set, and the program returns to step S3.

When the timer has not finished counting, the program moves on to step S6, where a decision is made repeatedly whether an OFF signal has been given by the sensor SEN6*a*, i.e., whether the SEN6*a* has detected that a document sheet X ceases to exist. Only when an OFF signal has been given by the sensor SEN6*a*, the program proceeds to step S7. When an OFF signal has not been given, i.e., when the sensor SEN6*a* continues to output the ON signal, the program returns to step S4.

At step S7, a decision is made whether the contents t of the forward counter is greater than $t'+\alpha$. The $t'$ is a value representing the time required for the previous document sheet X to pass the sensor SEN6*a*. The $\alpha$ is a predetermined constant. When $t>t'+\alpha$, a decision is made that a multiple feed of document sheets X occurred. When $t \leqq t'+\alpha$, a decision is made that a normal transfer of the sheets X is being performed.

The reason will be described with reference to FIGS. **6*a* and 6*b***.

The contents t of the forward counter indicates a continuing time of the ON signal from the sensor SEN6*a*, in other words, the time in millisecond in which the current document sheet X has continued to exist at the position of the sensor SEN6*a*.

As shown in FIG. **6*a***, when the document sheets X are transferred normally one after another, the continuing time t ($=t_1$) of the ON signal from the sensor SEN6*a* equals the continuing time of the ON signal from the sensor SEN6*a* with the previous document sheet X, namely, the passage time $t'$ of the previous document sheet X. For example, when a 8.5"×11" document is transferred normally at a transfer speed of 450 mm/s, the passage time $t'$ of the previous sheet X is 216 mm/ 450 mm/s=480 ms. The continuing time of the ON signal with the current sheet X, too, is $t=t'=480$ ms.

As shown in FIG. **6*b***, when multiple document sheets X are sent simultaneously, the continuing time t ($=t_2$) of the ON signal from the sensor SEN6*a* is $t>t'$. Theoretically, the document sheets X are fed simultaneously when $t>t'$. However, to eliminate the instability of decision due to measurement errors, for example, a decision is made that a multiple feed has occurred when $t > t' + \alpha$ in this embodiment.

Therefore, when $t \leqq t' + \alpha$, the document sheets X are considered as being transferred normally, and the program proceeds to step S8. At step S8, the passage t time of the current sheet X is stored as the passage time t' of the previous sheet X. To be more specific, processing of $t' \leftarrow t$ is performed. Then, the program returns to step S1, the passage time of the next sheet X is measured. When $t > t' + \alpha$, it is considered that there is a possibility that a multiple feed of document sheets X has occurred, and the program moves on to step S9. At step S9, a decision is made whether the document sheet X is the first one. If the document sheet X is the first one, a multiple feed can never have occurred and the program goes on to the above-mentioned step S8. When the sheet X is the second or any subsequent one, since it is considered that a multiple feed has occurred, the program advances to step S10. At step S10, the copying paper in the process of image transfer is ejected to the outside, the feeding of document sheets is stopped, so that the copier is shut down.

As has been described, according to this embodiment, an occurrence of a multiple feed of document sheets can be detected accurately and immediately, and the copying operation can be stopped. Therefore, the occurrence of unexecuted copying or ineffective copying caused by a multiple feed of document sheets can be minimized.

Figure 7A:
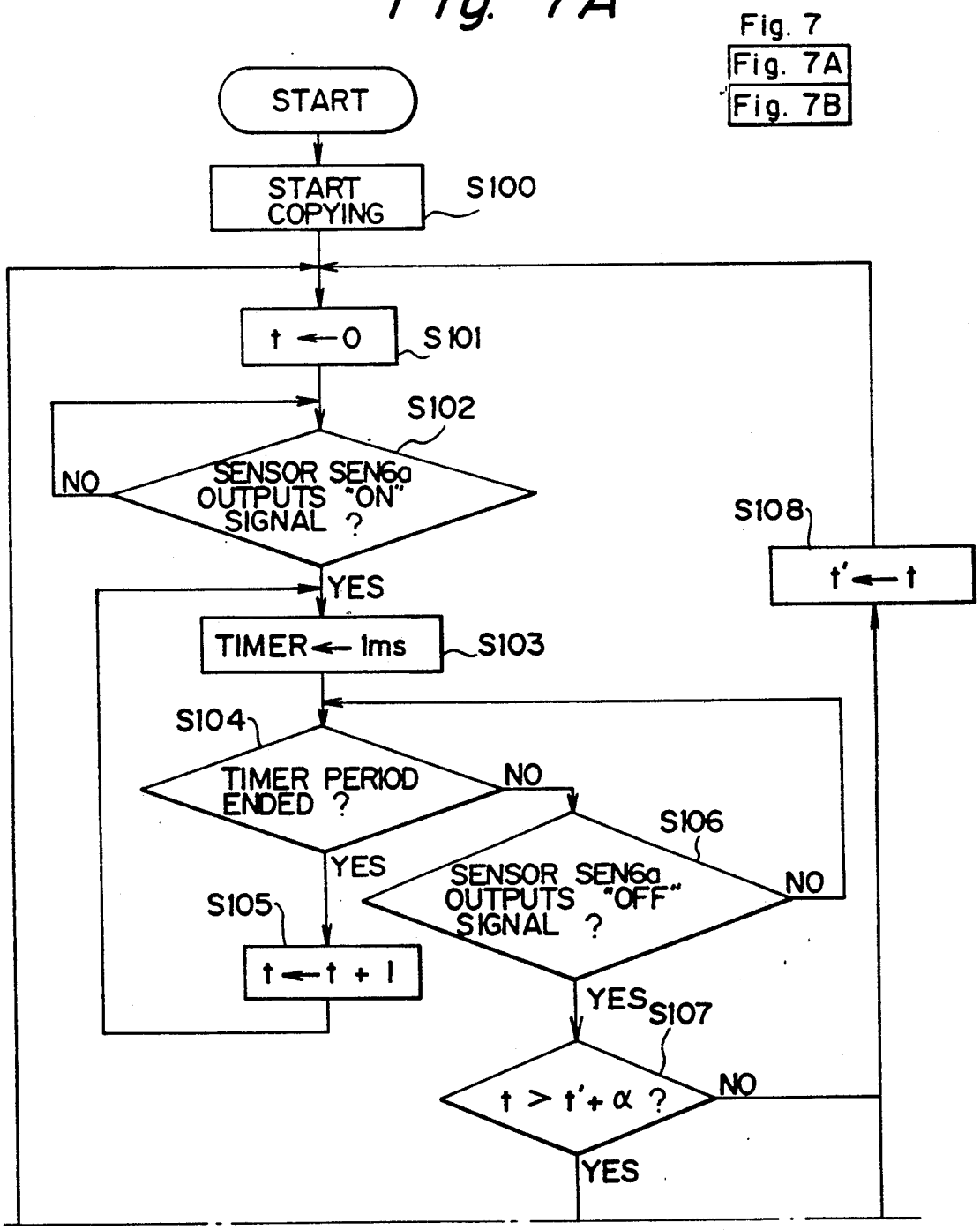
FIG. 7 composed of FIGS. 7A and 7B is a flowchart of a program for determining an occurrence of a multiple feed and also for the operation control of the copier according to this determination in another embodiment of the present invention.
Figure 7B:
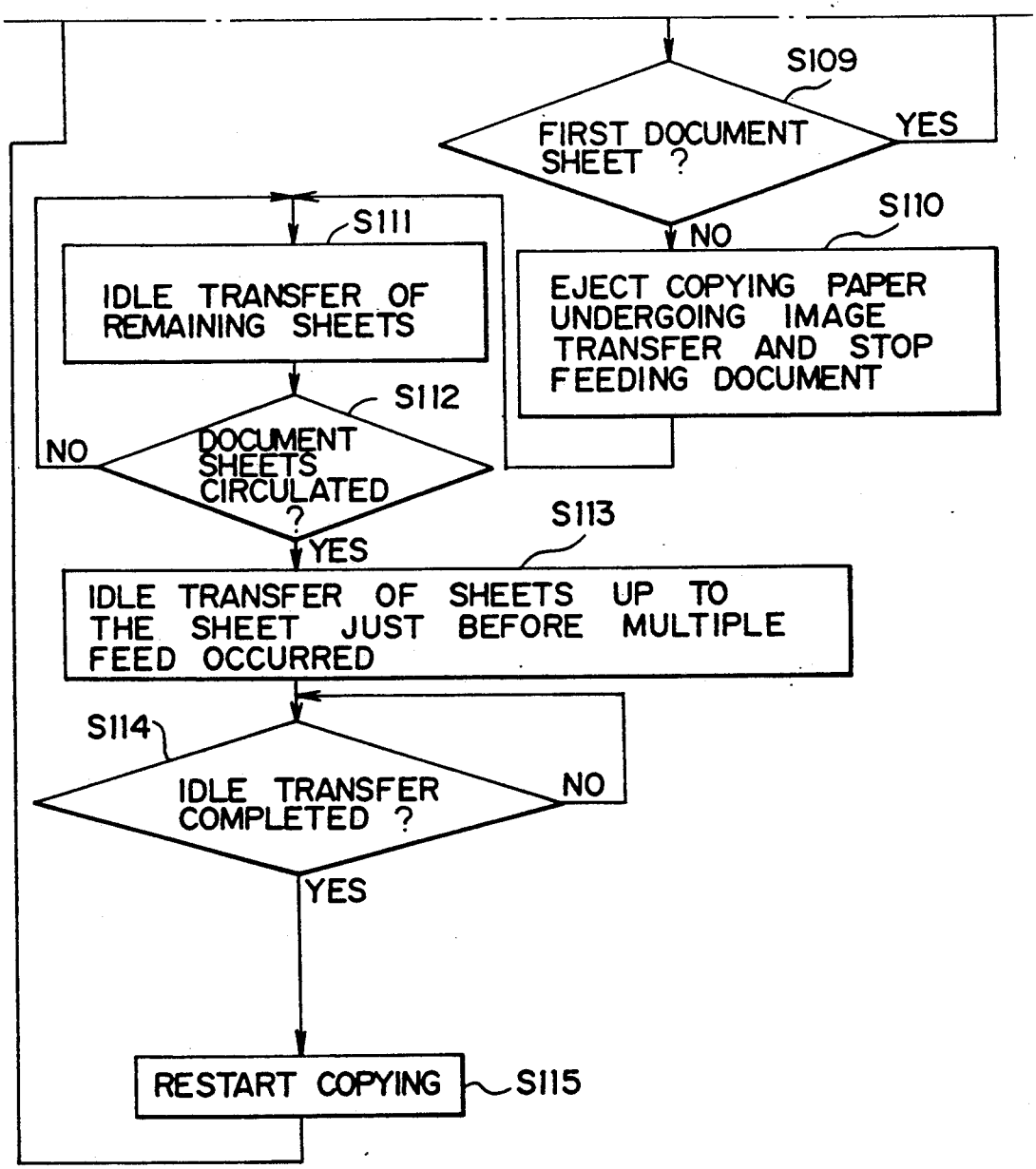

FIG. 7 composed of FIGS. 7A and 7B is a flowchart of a program that the microprocessor 205 executes to determined an occurrence of a multiple feed of document sheets X and to control the operation of the copier according to this determination in another embodiment of the present invention.

At step S100, a copying operation is started. The processing contents of the subsequent steps S101 to S110 are exactly the same as those of the steps S1 to S10 in FIG. 5, and therefore, their description is omitted.

At step S110, the copying paper in the process of image transfer is ejected to the outside, the feeding of document sheets X is stopped, so that the operation of the copier is shut down. After this, the program moves on to step S111, where the remaining document sheets X which have not been copied are transferred idly until all those sheets X have been circulated. Whether all those document sheets have been circulated is decided at step S112. When the remaining document sheets X which have not been copied have been circulated idly and collected in the document hopper 11, the program advances to the next step S113.

At step S113, a recovery process is started. Specifically, the exposed document sheets X are transferred idly until the document just before the occurrence of the multiple feed is transferred. Whether or not this idle transfer has been finished is decided at step S114. When the document sheets up to the sheet X just before the occurrence of the multiple feed have been circulated idly, the program proceeds to step S115, where copying is restarted by starting exposure with the sheets X which were involved in the multiple feed.

As described, according to this embodiment, it is possible not only to stop the copying operation by accurately and immediately detect an occurrence of a multiple feed of document sheets X, but also to effect a multiple-feed recovery by automatically circulating document sheets X so that copying can be resumed with the consecutive document sheets X which were sent simultaneously by the multiple feed. Therefore, time loss can be minimized and the occurrence of unexecuted copying or ineffective copying by the multiple document feed can be minimized.

Figure 8A:
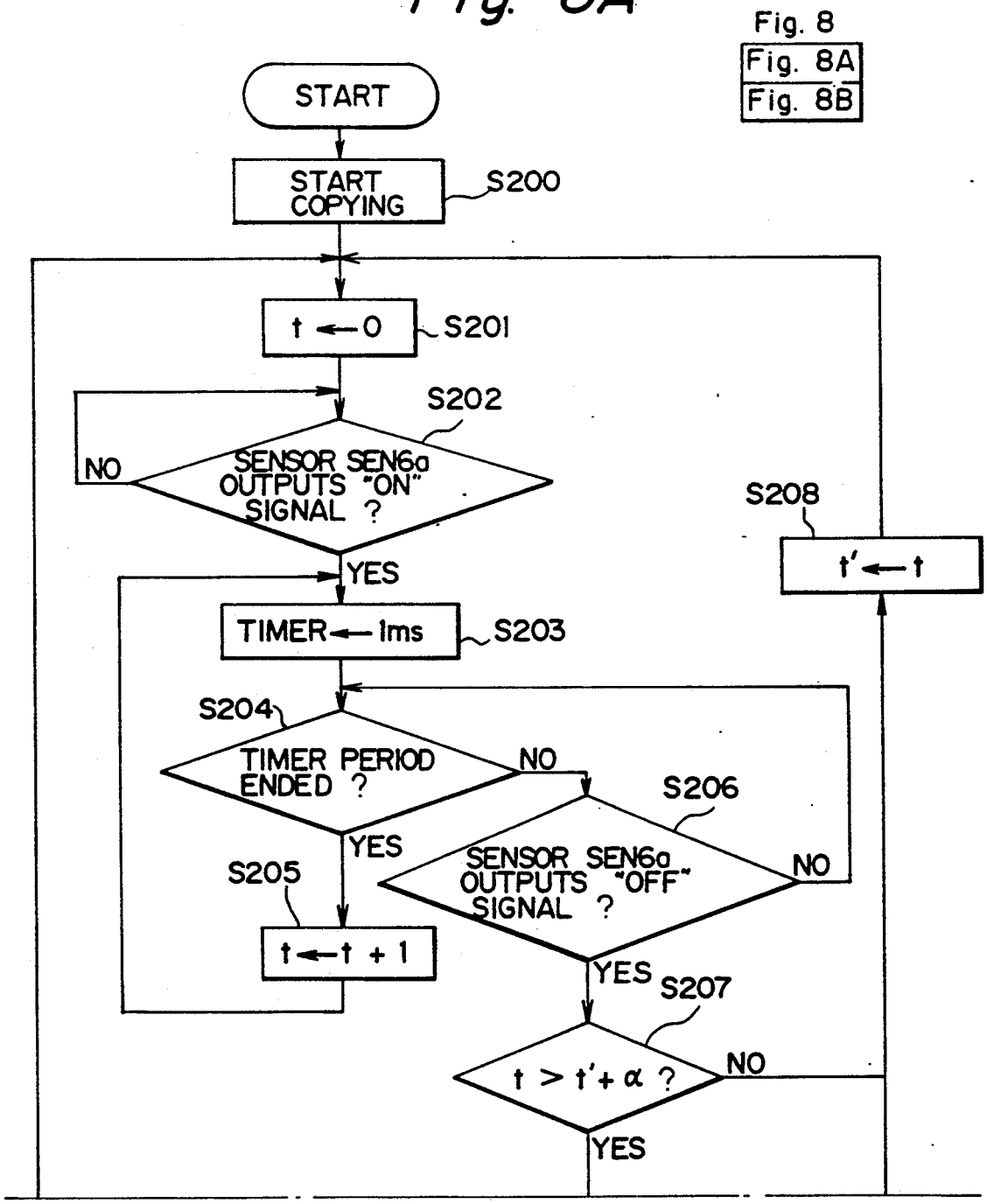
FIG. 8 composed of FIGS. 8A and 8B is a flowchart of a program for determining an occurrence of a multiple feed and also for the operation control of the copier according to this determination in a further another embodiment of the present invention.
Figure 8B:
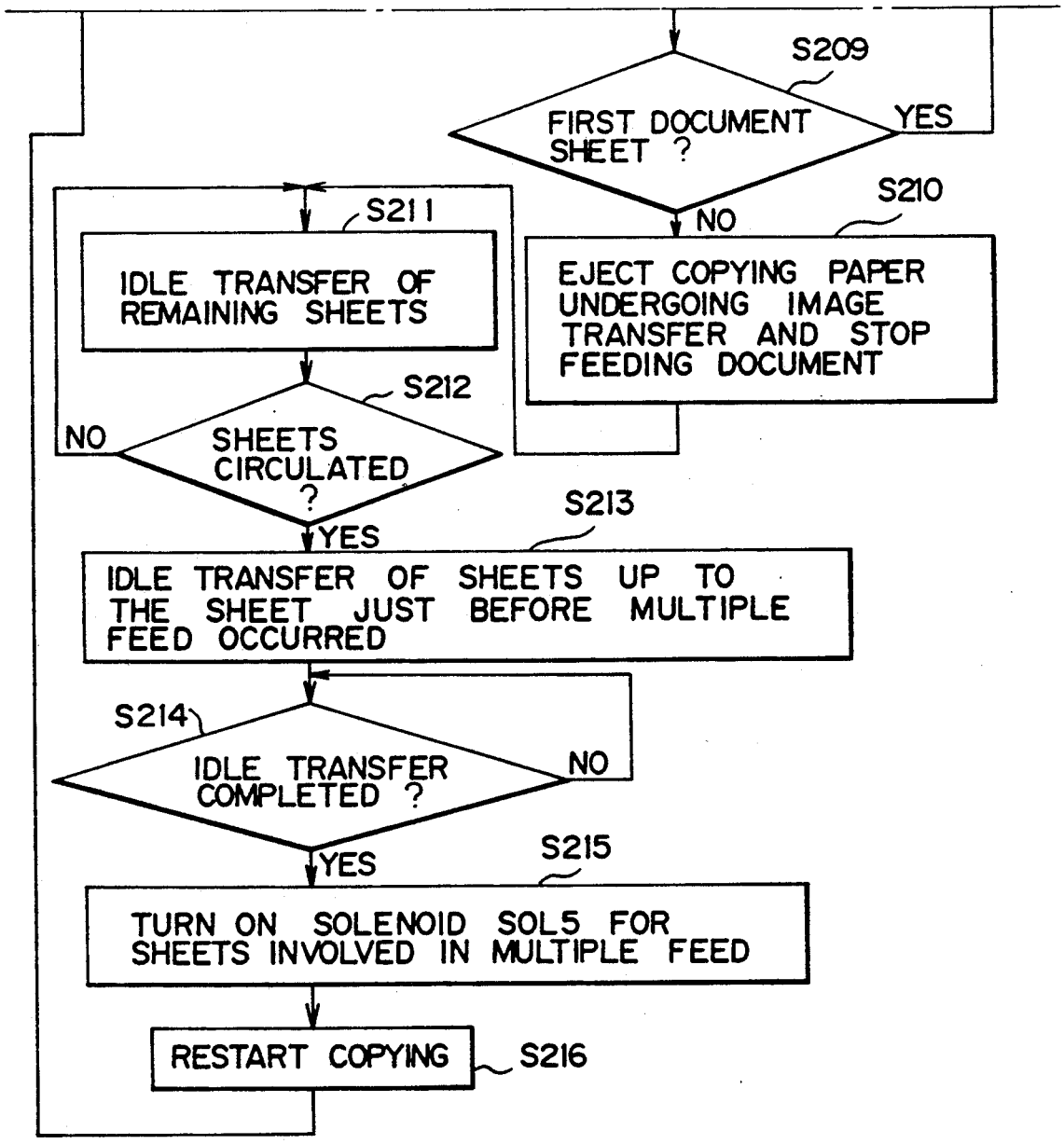

FIG. 8 composed of FIGS. 8A and 8B is a flowchart of a program that the microprocessor 205 executes to determine an occurrence of a multiple feed of document sheets X and control the operation of the copier according to this determination.

The processing contents of the steps S200 to S214 are exactly the same as those of the steps S100 to S114, and their description is omitted.

When at step S214 a decision is made that the document sheets X including the sheet just before the occurrence of the multiple feed have been transferred idly, the program moves on to the next step S215, where the solenoid SOL5 is operated only for the document sheets X involved in the multiple feed. By this, the pressing force of the document separating roller 24*b* (FIG. 2) us increased, so that the sheets X sent simultaneously by the multiple feed can be separated securely. After this, the program advances to step S216, where copying is restarted by starting exposure with the sheets X sent simultaneously by the multiple feed.

It ought to be noted that if the increased pressing force is constantly given to the document separating roller 24*b*, the roller may be abased or the document sheets may be damaged, and for this reason, the pressing force is increased to improve the document separating performance only when the sheets X involved in the multiple feed pass the roller 24*b*.

As has been described, according to this embodiment, not only an occurrence of a multiple feed is detected accurately and immediately to enable ongoing copying to be stopped, but also recovery is effected by separating the document sheets X involved in the multiple feed with an increased document separating force when restarting copying with the simultaneously-fed consecutive sheets X after the document sheets X are circulated automatically. Therefore, it is possible to securely prevent an occurrence of a multiple feed again with those sheets X once involved in the multiple feed and minimize the occurrence of unexecuted copying or ineffective copying owing to the multiple feed.

Figure 9A:
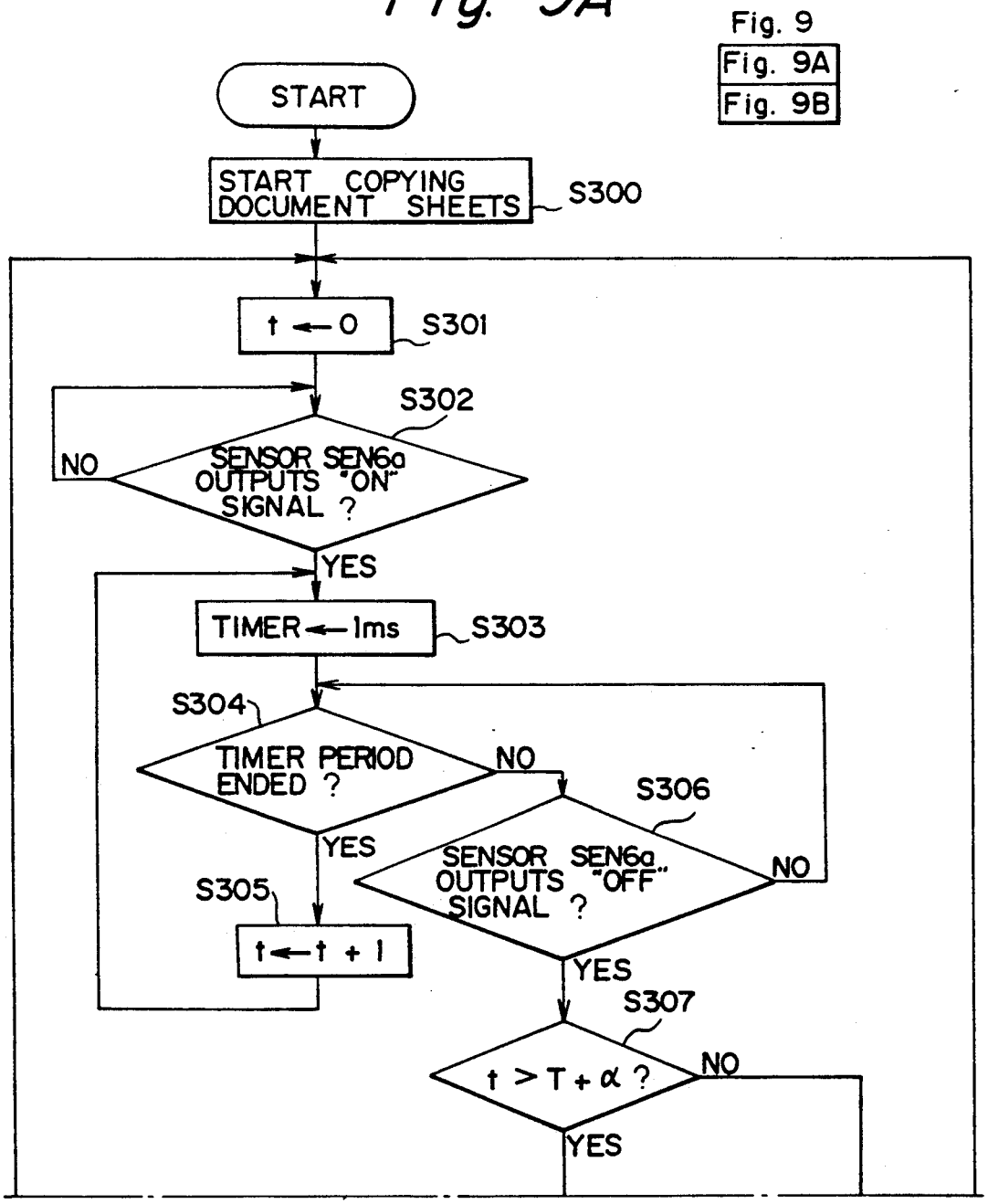
FIG. 9 composed of FIGS. 9A and 9B is a flowchart of a program for counting the number of document sheets in yet another embodiment of the present invention.
Figure 9B:
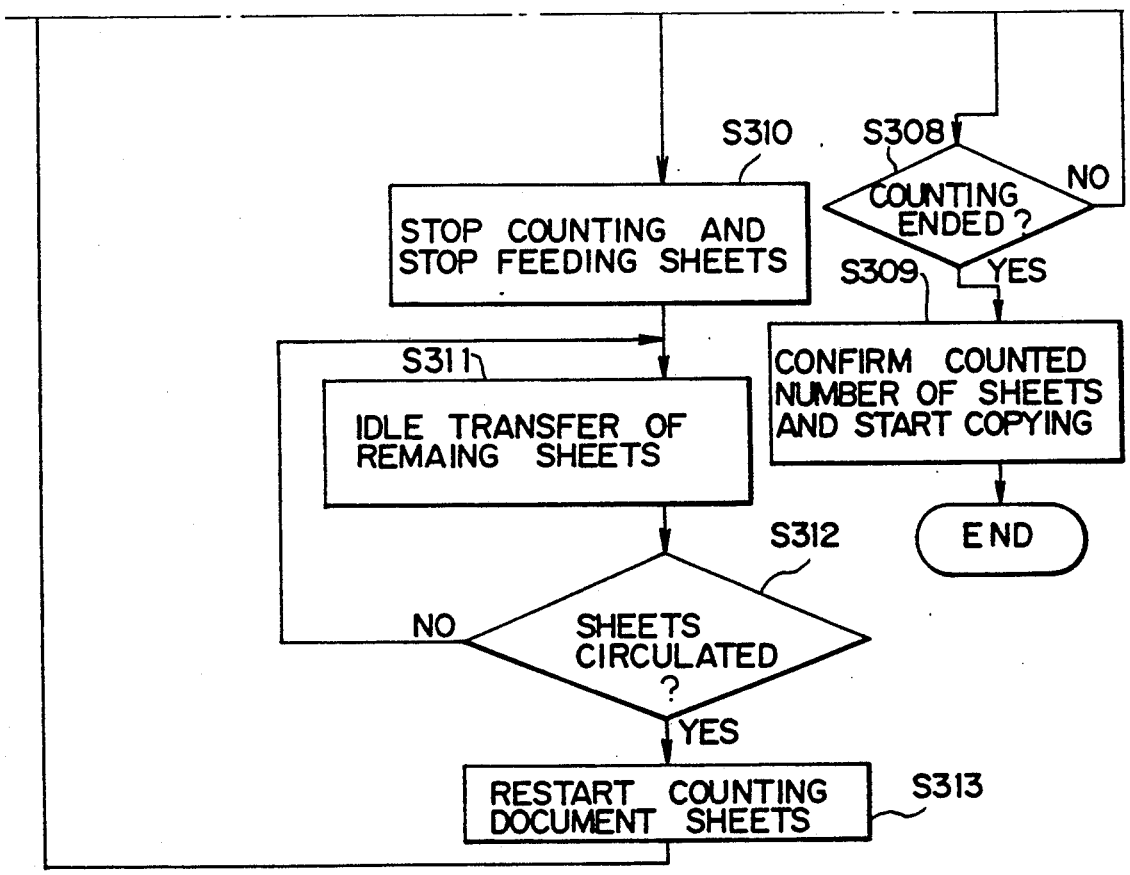

FIG. 9 composed of FIGS. 9A and 9B is a flowchart of a program that the microprocessor 205 executes to count the number of document sheets X in yet another embodiment of the present invention. For example, in the mode of producing a duplex copy from a simplex document, the program of FIG. 9 first counts the number of document sheets X.

When the document handler is put into operation, at step S300 the number of document sheets is counted. At the next step S301, the contents of the forward counter are initialized by $t \leftarrow 0$. At the next step S302, a decision is made repeatedly whether or not an ON signal has been supplied from the sensor SEN6*a*, i.e., whether the sensor SEN6*a* has detected the presence of a document sheet X at the position of the sensor SEN6*a*.

Only when an ON signal has been given from the sensor SEN6*a*, the program proceeds to the next step S303, where a value corresponding to 1 ms is set on the timer. At the subsequent step S304, a decision is made whether the timer has finished counting, i.e., whether 1 ms has elapsed. When 1 ms has elapsed, the program moves on to step S305, where the contents t of the forward counter are incremented, and the program returns to step S303. In other words, $t \leftarrow t+1$ is set, and the program returns to step S303.

When the timer has not finished counting, the program moves on to step S306, where a decision is made repeatedly whether an OFF signal has been given by the sensor SEN6*a*, i.e., whether the SEN6*a* has detected that a document sheet X ceases to exist. Only when an OFF signal has been given by the sensor SEN6*a*, the program proceeds to step S307. When an OFF signal has not been given, i.e., when the sensor SEN6*a* continues to output an ON signal, the program returns to step S304.

At step S307, a decision is made whether the contents t of the forward counter is greater than $T+\alpha$. The T is a value representing the time required for a document sheet X to pass the sensor SEN6*a*. The $\alpha$ is a predetermined constant. When $t > T+\alpha$, a decision is made that a multiple feed of documents sheets X occurred. When $t \leqq T+\alpha$, a decision is made that a normal transfer of the sheets X is being performed.

The contents t of the forward counter indicates a continuing time of the ON signal from the sensor SEN6*a*. In other words, the time in millisecond in which the document sheet X has continued to exist at the position of the sensor SEN6*a*.

Figure 6A:
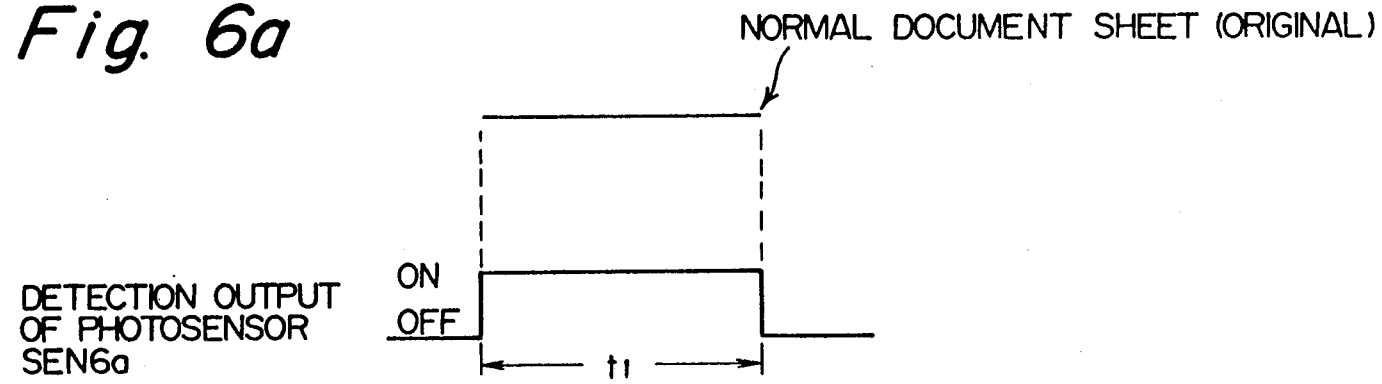
FIGS. 6*a* and 6*b* illustrate a method of determining an occurrence of a multiple feed of a document sheet.

As shown in FIG. 6*a*, when the document sheets X are transferred normally one after another, the continuing time t ($=t_1$) of the ON signal from the sensor SEN6*a* equals the document passage time T previously calculated from the size of the sheet X and its transfer speed. For example, when a 8.5"×11" document is transferred normally at a transfer speed of 450 mm/s, the document passage time T is 216 mm/450 mm/s=480 ms. The continuing time t of the ON signal is t=T=480 ms.

Figure 6B:
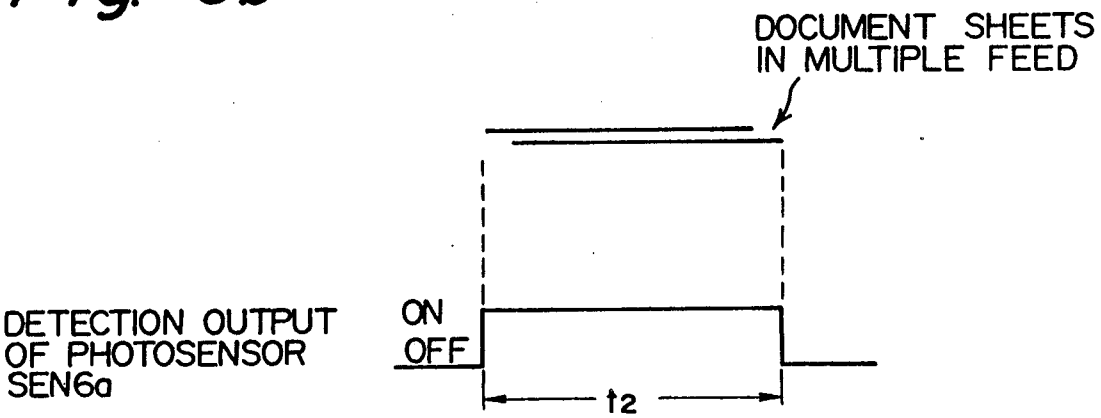

As shown in FIG. 6*b*, when multiple document sheets X are transferred simultaneously, the continuing time t($=t_2$) of the ON signal from the sensor SEN6*a* is $t>T$. Theoretically, the document sheets X are transferred simultaneously when $t>T$. However, to eliminate the instability of decision due to measurement errors, for example, a decision is made that a multiple feed has occurred when $t>T+\alpha$ in the present invention.

Therefore, when $t \leqq T+\alpha$, the document sheets X are considered as being transferred normally, and the program proceeds to step S308, where a decision is made whether the document sheets X have all been transferred and counting of the number of sheets X has ended. When the counting has ended, at step S309 the counted number of sheets X is confirmed, and then, a copying operation is started. On the other hand, when the counting of the number of sheets X has not been ended, the program returns to step S301, and the passage time of the next document sheet X is measured.

When $t>T+\alpha$, a multiple feed is considered to have occurred, and the program proceeds to step S310. At step S310, the counting of the number of document sheets X is stopped, and the feeding of document sheets is stopped.

Then, the program advances to step S311, where the remaining document sheets X are transferred idly until all those documents sheets have been circulated. Whether those document sheets X have been circulated is decided at the next step S312. When the remaining document sheets X have all been circulated idly and collected in the document hopper 11, the program advances to the next step S113.

At step S313, the counting of the number of document sheets X under way is resumed to make it possible to start counting the number of document sheets X from the beginning. The program returns to step S301.

According to this embodiment, an occurrence of a multiple feed of document sheets X can be detected accurately and immediately and the counting of the number of document sheets X can be stopped. Therefore, it is possible to prevent copying from be made with a wrong count caused by a multiple document feed. More specifically, since copying can be done with a correct count of document sheets, when copying is performed in compliance with the counted number of document sheets X as in the mode of duplex copying from a simplex document, for example, an occurrence of unexecuted copying or ineffective copying owing to a displacement of the contents on the front and back sides of the document sheets with respect to each other can be minimized.

Figures 10, 10A, 10B:
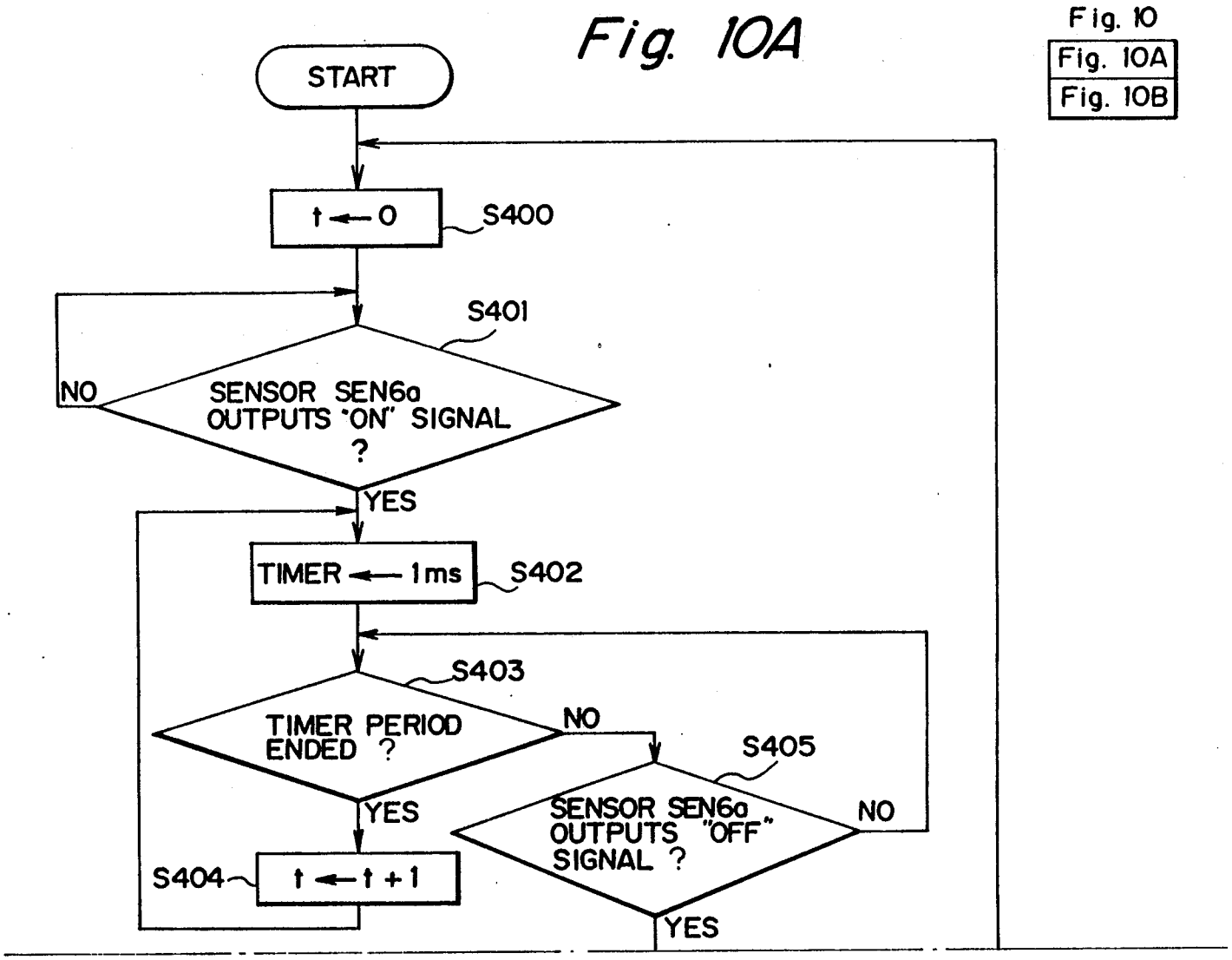
FIG. 10 composed of FIGS. 10A and 10B is a flowchart of a program for determining an occurrence of a multiple feed in a still further embodiment of the present invention.
Figure 10B:
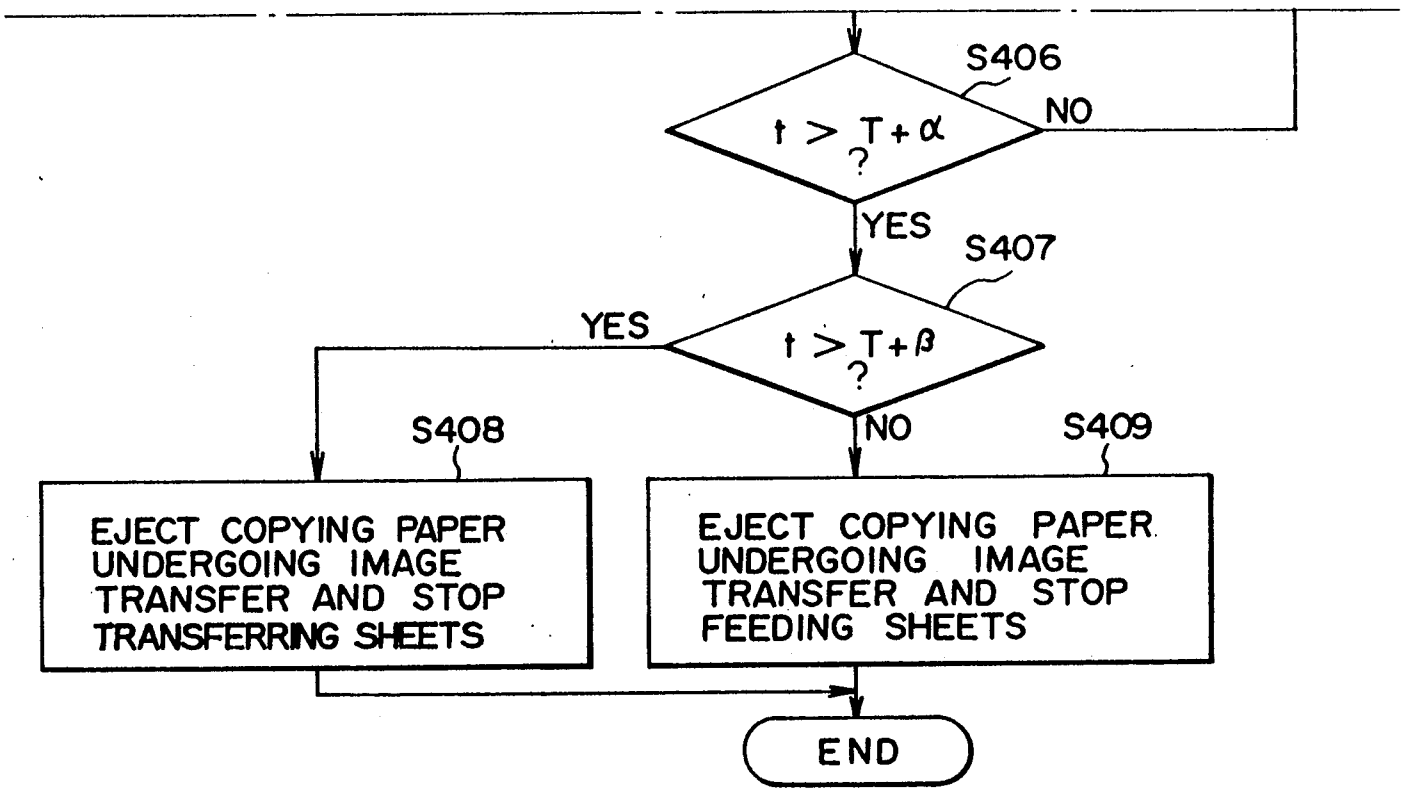

FIG. 10 composed of FIGS. 10A and 10B is a flowchart of a program that the microprocessor 205 executes to determine an occurrence of a multiple feed and control the operation of the copier according to this determination in a still further embodiment of the present invention.

The processing contents of the steps S400 to S405 are exactly the same as those of the steps S301 to S306 in the embodiment shown in FIG. 9, and their description is omitted.

At step S406, a decision is made whether the contents t of the forward counter is greater than $T+\alpha$. The T is a value representing a time required for a document sheet X to pass the position of the sensor SEN6*a*, and is calculated from the size and the transport speed of the document sheet X. The $\alpha$ is a constant. When $t>T+\alpha$, a decision is made that a multiple feed has occurred. When $t \leqq T+\alpha$, a decision is made that normal transfer is going on, and the program returns to step S400, where a passage time of the next document sheet X is measured. When $t>T+\alpha$, since it is considered that a multiple feed is likely to have occurred, the program advances to step S407.

At step S407, a decision is made whether the contents t of the forward counter are greater than $T+\beta$. The T is a value representing a time required for a document sheet X to pass the position of the sensor SEN6*a*, and is calculated previously from the size and the transport speed of a document sheet X. The $\beta$ is a predetermined constant and $\beta>\alpha$. $T+\beta$ is a time converted from the maximum value of the document length acceptable in the document hopper 11 when a multiple feed occurred.

When $t>T+\beta$, a decision is made that since the document sheets fed simultaneously are greatly displaced with respect to each other, at least a part of the extends into the transfer path 18, and the program proceeds to step S408. At this step S408, the current condition is regarded as a jamming, and not only the copying paper undergoing image transfer is ejected to the outside and the feeding of document sheets X is stopped, but also the transfer of the document sheets X is stopped immediately.

When $T \leqq T+\beta$, the program advances to step S409. At step S409, the copying paper undergoing image transfer is ejected to the outside, the feeding of document sheets x is stopped, and the operation of the copier is shut down. Note, however, that the transfer of the document sheet X under way continues.

According to this embodiment, an occurrence of a multiple feed can be detected accurately and immediately to stop the copying operation, so that the occurrence of unexecuted copying or ineffective copying due to a multiple feed can be minimized. In addition, when the continuous time of presence of a document sheet X is remarkably long, the transfer of document sheets X is also stopped immediately. Therefore, it is possible to prevent such an accident that the simultaneously-fed document sheets X displaced so greatly with respect to each other that they cannot return in their entirety into the document hopper 11, a part of the rear one of those document sheets X is left extending into the transfer path 18 and damaged by the rollers, for example, or in the worst case, the rear one of the simultaneously-fed sheets X does not reach the document hopper 11 and jammed in the transfer process.

Figure 11:
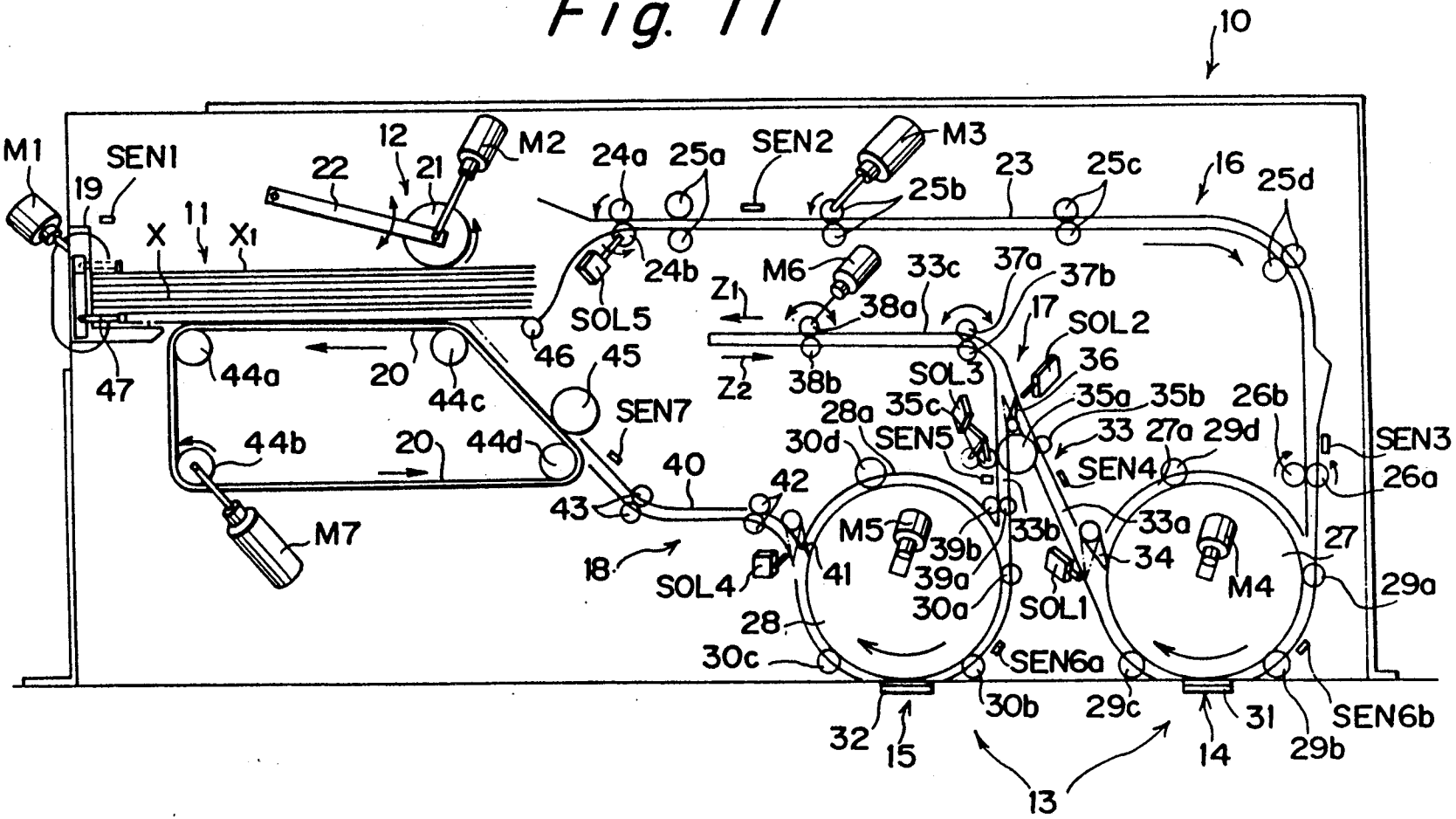
FIG. 11 shows in detail a recycle document handler in an additional embodiment of the present invention.

FIG. 11 is a detailed representation of the construction of the recycle document handler in a still further embodiment of the present invention.

The recycle document handler in this embodiment differs from the recycle document handler of FIG. 2 in that in addition to the sensor SEN6*a* located in the vicinity of the second exposure station 15, there is further provided in the vicinity of the first exposure station another sensor SEN6*b* for detecting a multiple feed by sensing the presence of a document sheet X. But, in the other respects, the construction is the same. To be more precise, this sensor SEN6*b* is provided between the rollers 29*a* and 29*b* near the transfer path 27*a* of the first document cylinder 27. The sensor SEN6*b* corresponds to the first sensor in the present invention, and the sensor SEN6*a* corresponds to the second sensor in the present invention.

Figures 12, 12A, 12B:
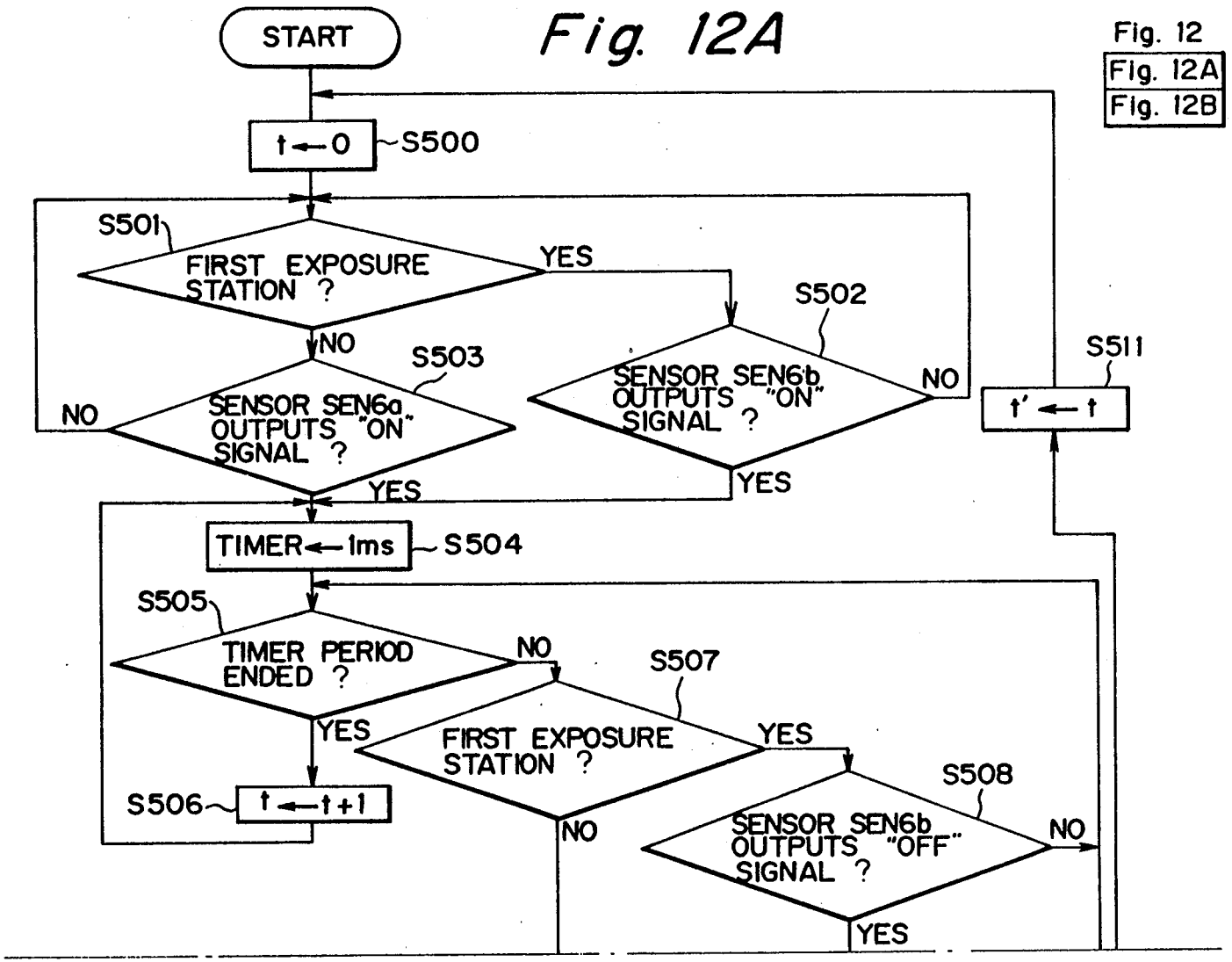
FIG. 12 composed of FIGS. 12A and 12B is a flowchart of a program for determining an occurrence of a multiple feed in the embodiment shown in FIG. 11.
Figure 12B:
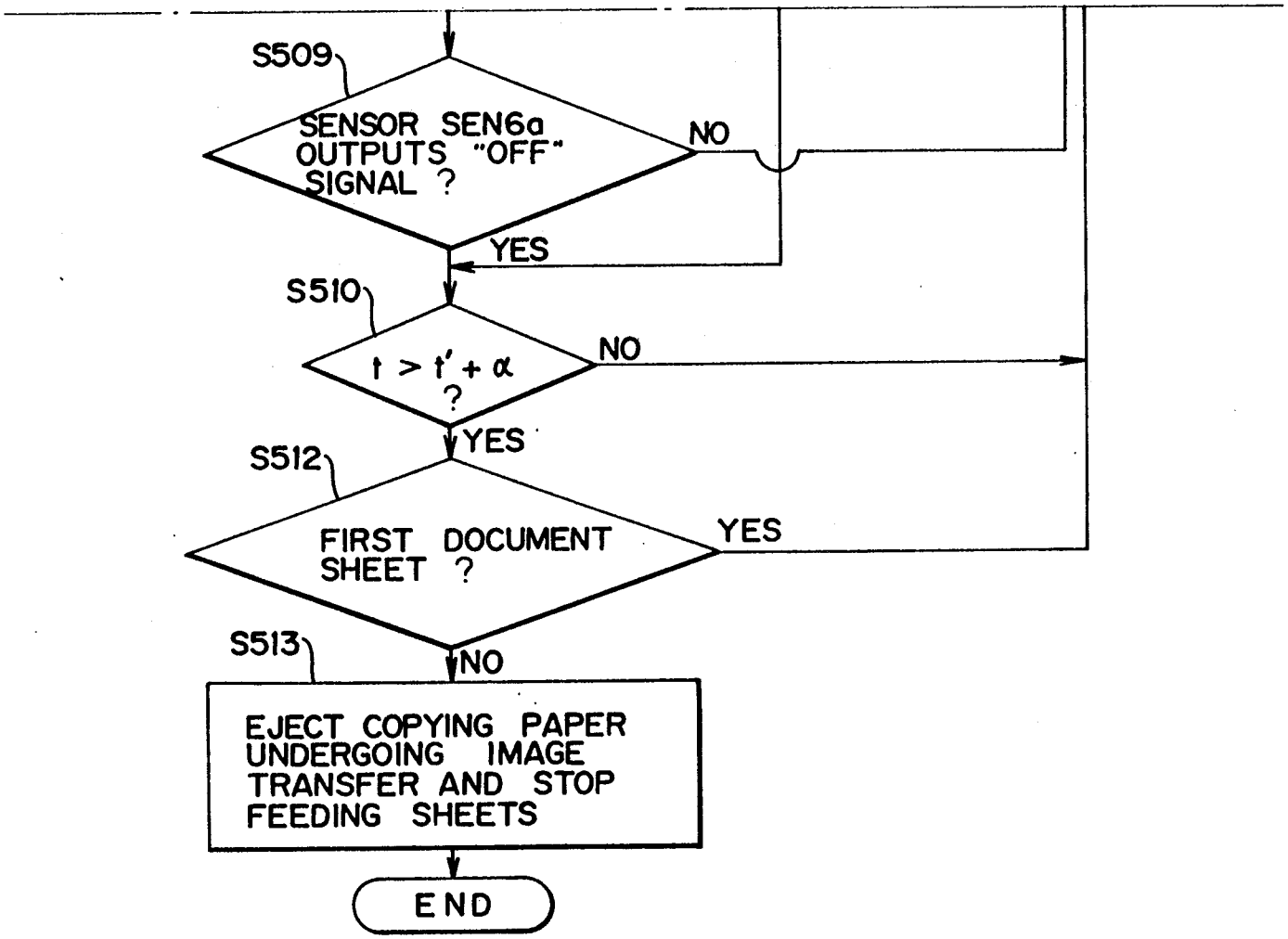

FIG. 12 composed of FIGS. 12A and 12B is a flowchart of a program that the microprocessor 205 executes to determine an occurrence of a multiple feed in this embodiment and to control the operation of the copier according to this determination. When the operation of the document handler 10 is started, first at step S500, the contents t of the forward counter are initialized by $t \leftarrow 0$. At the next step S501, a decision is made whether exposure is performed at the first document cylinder 27, that is, at the first exposure station 14. When exposure is performed at the first exposure station 14, the program moves on to step S502, a decision is repeatedly made whether an ON signal has been supplied from the sensor SEN6*b*, i.e., whether a document sheet X exists in the vicinity of the first exposure station 14. Only when an ON signal has been given by the sensor SEN6*b*, the program advances to step S504. When exposure is not performed at the first exposure station 14, a decision is made that exposure is performed at the second document cylinder 28, that is, at the second exposure station 15, and the program proceeds to step S503. At the step S503, a decision is made repeatedly whether an ON signal has been given by the sensor SEN6*a*, namely, whether a document sheet X exists in the vicinity of the second exposure station 15. Only when an ON signal has been given by the sensor SEN6*a*, the program advances to step S504.

At step S504, a value corresponding to 1 ms is set on the timer. At the next step S505, a decision is made whether the timer has ended counting, i.e., whether 1 ms elapsed. When 1 ms has elapsed, the program moves on to step S506, where the contents t of the forward counter are incremented by $t \leftarrow t+1$ and the program returns to step S504.

When the timer has not ended counting, the program advances to step S507, whether exposure is done at the first exposure station 14. When exposure is done at the first exposure station, the program proceeds to step S508, where a decision is made whether an OFF signal has been given by the sensor SEN6*b*, namely, whether the sensor SEN6*b* has detected that a document sheet X ceases to exist in the vicinity of the first exposure station 14. When an OFF signal has been given by the sensor SEN6*b*, the program advances to step S510. When an OFF signal has not been given, i.e., the sensor SEN6*b* continues to output an ON signal, the program returns to step S505. When exposure is not done at the first exposure station 14, a decision is made that exposure is done at the second document cylinder side 28, namely, at the second exposure station 15, the program moves on to step S509. At step S509, a decision is made whether an OFF signal has been given by the sensor SEN6*a*, i.e., whether the sensor SEN6*a* has detected a document sheet X ceases to exist in the vicinity of the second exposure station 15. When an OFF signal has been given by the sensor SEN6*a*, the program moves on to step S510. When an OFF signal has not been given, i.e., when the sensor SEN6*a* continues to output an ON signal, the program returns to step S505.

At step S510, a decision is made whether the contents t of the forward counter are greater than $t'+\alpha$. The $t'$ is a value representing a time required for a document sheet X to pass the sensor SEN6*a* or SEN6*b*. The $\alpha$ is a predetermined value. When $t>t'+\alpha$, a decision is made that a multiple feed has occurred. When $t \leqq t'+\alpha$, a decision is made that normal transfer is being performed. The reason has been described with reference to FIGS. 6*a* and 6*b*.

When $t \leqq t'+\alpha$, a decision is made that the document transfer is being done normally, and the program advances to step S511. At step S511, the current passage time t is stored as the previous passage time $t'$. In other words, processing of $t' \leftarrow t$ is carried out, and the program returns to step S500, where a passage time of the next document sheet X is measured. When $t>t'+\alpha$, since it is considered that a multiple feed is likely to have occurred, the program proceeds to step S512. At step S512, a decision is made whether this document sheet X is the first one. When the sheet X is the first one, a multiple feed can never have occurred, the program moves on to the above-mentioned step S511. When the document sheet X is the second or any subsequent one, since it is considered that a multiple feed has occurred, the program advances to step S513. At the step S513, the copying paper undergoing a image transfer process is ejected to the outside, the feeding of document sheet is stopped, thereby shutting down the operation of the copier.

As has been described, according to this embodiment, a sensor for detecting an occurrence of a multiple feed is provided at each of the exposure stations, and those sensors are switched over between the two exposure stations. Therefore, a multiple feed can be detected and the copying operation can be stopped immediately, so that it is possible to minimize an occurrence of unexpected copying or ineffective copying due to a multiple feed of document sheets X.

In the various embodiments mentioned above, a continuous presence of a document sheet is detected by the sensor SEN6*a* at the second exposure station or by the sensors SEN6*a* and SEN6*b* respectively provided at the first and second exposure stations. In the present invention, however, the continuous presence of a document sheet may be detected by a sensor provided at any position so long as the sensor is located near a path which the document sheet passes through.

For the sensors SEN2 to SEN7, photo sensors, contact sensors or other types of sensors are used.

Many widely different embodiments of the present invention may be constructed without departing from the spirit and scope of the present invention. It should be understood that the present invention is not limited to the specific embodiments described in the specification, except as defined in the appended claims.

What is claimed is:

1. An automatic recycling document feeder for automatically feeding a plurality of document sheets to an exposure position from a tray and returning said document sheets to said tray after exposure, comprising;

a sensor, provided near a transit path of supplied document sheets, for detecting a presence of a document sheet at a position where said sensor is located;

means for obtaining one continuous time of presence of the document sheet according to detection output from said sensor;

detecting means for detecting an occurrence of a multiple feed when said continuous time of presence of a document sheet obtained this time is longer than a continuous time of presence of a document sheet obtained last time;

and means for idly transferring the document sheets from the tray instead of normal feeding for exposure until the document sheet just before the document sheets involved in the multiple feed is transferred from the tray, when said detecting means detects the occurrence of the multiple feed.

2. An automatic document feeder as claimed in claim 1, wherein said sensor is provided near a document transit path in the vicinity of the exposure position of a document sheet.

3. An automatic document feeder as claimed in claim 1, wherein said obtaining means includes means for measuring a continuing time of a signal from said sensor, said signal representing the presence of a document sheet.

4. An automatic document feeder as claimed in claim 1, wherein said detecting means includes means for neglecting the obtained continuous time of presence of the document sheet when the document sheet this time is the first piece of document sheet.

5. An automatic document feeder as claimed in claim 1, wherein said feeder further comprises means for resuming the normal feeding of document sheets for exposure after the idle transfer is done by said idle transfer means.

6. An automatic document feeder as claimed in claim 1, wherein said feeder further comprises means for separating the document sheets involved in the multiple feed after the idle transfer by said idle transfer means, and means for resuming the normal feeding of document sheets for exposure after a document separation is done by said document separating means.

7. An automatic recycling document feeder for automatically feeding a plurality of document sheets to an exposure position from a tray and returning said document sheets to said tray after exposure, comprising:

means for counting the number of document sheets supplied;

a sensor, provided near a transit path of document sheets supplied, for detecting a presence of a document sheet at a position where said sensor is located;

means for obtaining a continuous presence time of a document sheet according to detection output from said sensor;

counting stopping means for stopping the counting of the number of document sheets as it is considered that a multiple feed of document sheets has occurred when the continuous presence time obtained is longer than a specified time determined according to the size of a document sheet;

means for idly transferring document sheets instead of normal feeding for exposure until the document sheet just before the sheets involved in the multiple feed is transferred from the tray; and means for resuming the normal feeding and the counting of document sheets after the idle transfer is done by said idle transfer means.

8. An automatic document feeder as claimed in claim 7, wherein said sensor is provided near a document sheet transit path in the vicinity of the exposure position of the document sheets.

9. An automatic document feeder as claimed in claim 7, wherein said obtaining means includes means for measuring a continuing time of a signal from said sensor, said signal representing a presence of a document sheet.

* * * * *